US011732920B2

(12) United States Patent
Gooding et al.

(10) Patent No.: US 11,732,920 B2
(45) Date of Patent: Aug. 22, 2023

(54) AIR CONDITIONING SYSTEM

(71) Applicant: EasyAirConditioning Group Limited, Birmingham (GB)

(72) Inventors: Neal Robert Gooding, Birmingham (GB); Adrian Geoffrey Terrett, Birmingham (GB)

(73) Assignee: EasyAirConditioning Group Limited

( * ) Notice: Subject to any disclaimer, the term of this patent is extended or adjusted under 35 U.S.C. 154(b) by 177 days.

(21) Appl. No.: 17/259,091

(22) PCT Filed: Jul. 10, 2019

(86) PCT No.: PCT/GB2019/051930

§ 371 (c)(1),
(2) Date: Jan. 8, 2021

(87) PCT Pub. No.: WO2020/012174

PCT Pub. Date: Jan. 16, 2020

(65) Prior Publication Data

US 2021/0318019 A1 Oct. 14, 2021

(30) Foreign Application Priority Data

Jul. 10, 2018 (GB) ..... 1811307
Nov. 23, 2018 (GB) ..... 1819088

(51) Int. Cl.
*F24F 11/84* (2018.01)
*F24F 3/08* (2006.01)

(52) U.S. Cl.
CPC ..... *F24F 11/84* (2018.01); *F24F 3/08* (2013.01); *F24F 2221/54* (2013.01)

(58) Field of Classification Search
CPC ..... F24F 11/84; F24F 3/08; F24F 2221/54; F24F 11/89
See application file for complete search history.

(56) References Cited

U.S. PATENT DOCUMENTS 3,191,667 A 6/1965 Lorenz
3,256,929 A 6/1966 Carlson
(Continued)

FOREIGN PATENT DOCUMENTS

GB 1166047 A 10/1969
JP H0484038 A 3/1992
(Continued)

OTHER PUBLICATIONS

International Preliminary Report on Patentability for International Application No. PCT/GB2019/051930, dated Jan. 12, 2021, 12 pages.
(Continued)

*Primary Examiner* — Schyler S Sanks
(74) *Attorney, Agent, or Firm* — Boyle Fredrickson, S.C.

(57) ABSTRACT

An air conditioning system (1) has a heater unit (3) providing a hot water flow (7) and receiving a hot water return (31) in hot water loop, a chiller unit (5) providing a cold water flow (13) and receiving a cold water return (33) in a cold water loop, one or more air to water heat exchangers (17), and one or more control valves (11), each control valve (11) associated with one of the air to water heat exchangers (17) and arranged to receive the hot water flow (7) and cold water flow (13), selectively provide the flow from a one of the hot water loop or cold water loop to the associated air to water heat exchanger (17), receive a return from the associated air to water heat exchanger (17), and selectively provide the return from the associated air to water heat exchanger (17) to the return of the one of the hot water loop or cold water loop.

20 Claims, 21 Drawing Sheets

(56) References Cited

U.S. PATENT DOCUMENTS

| | | | | |
|---|---|---|---|---|
| 2013/0199722 | A1 | 8/2013 | Burbank et al. | |
| 2013/0199772 | A1* | 8/2013 | Fischer | F24D 3/02 165/96 |
| 2013/0233008 | A1 | 9/2013 | Yamashita et al. | |
| 2014/0245762 | A1* | 9/2014 | Schlesinger | F25B 49/02 62/235.1 |
| 2015/0226343 | A1 | 8/2015 | Jenks | |
| 2015/0300359 | A1* | 10/2015 | Kashihara | F24F 1/50 415/26 |
| 2016/0003489 | A1 | 1/2016 | Casper et al. | |
| 2016/0003561 | A1* | 1/2016 | Casper | F28F 13/06 165/201 |

FOREIGN PATENT DOCUMENTS

| | | | |
|---|---|---|---|
| JP | H07239139 | A | 9/1995 |
| WO | 2014137968 | A2 | 9/2014 |
| WO | 2014137971 | A2 | 9/2014 |

OTHER PUBLICATIONS

Examination Report for Application No. GB1819088.4, dated Feb. 21, 2020, 3 pages.
Examination Report for Application No. GB1819088.4, dated Oct. 10, 2019, 4 pages.
Combined Search and Examination Report for Application No. GB1819088.4, dated Apr. 29, 2019, 7 pages.

* cited by examiner

AIR CONDITIONING SYSTEM

This application is a 371 of international PCT/GB2019/051930, filed Jul. 10, 2019, which claims priority to UK Patent Application No. 1811307.6, filed on Jul. 10, 2018, and UK Patent Application No. 1819088.4, filed on Nov. 23, 2018, the contents of each of which are hereby incorporated by reference.

The present invention relates to an air conditioning system, a changeover box for an air conditioning system, a kit arranged to form part of an air conditioning system, and a method of retro-fitting a water based air conditioning system.

In the following description, the changeover box shall be referred to as VWVK (Variable Water Volume Kit). It will also be appreciated that the changeover box may be considered to be a connector box or switching box.

One type of air conditioning is variable refrigerant flow (VRF), which is also known as variable refrigerant volume (VRV). In a VRF/VRV system, refrigerant is passed via 2 or 3 pipes to a changeover box, which then delivers refrigerant to a fan coil unit via two pipes. The fan coil provides heating or cooling simultaneously on the same system, this is all done through the process of the refrigerant cycle using refrigerant gases.

With refrigerants becoming more and more expensive and the current gases not seen to be green, acceptance of VRF/VRV systems is falling, and although new gases are being launched into the market, which do meet "environmental requirements" these are made up of mixtures of gases which are classed as flammable, and which do not have the same performance characteristic as current gases. This is likely to create issues with health and safety and public perception are deemed unlikely to be accepted.

Water based air conditioning systems use a chiller and a boiler, with separate cold and hot water flows and returns to each of a number of fan coil units. Such systems are seen as disjointed, as one company supplied the boilers, another the chillers, another company the fan coil units, another company the controls and a further company has to combine the elements and develop the design to deliver the final system, including pipe sizing, pumps etc. The system also required four pipes leading to and from each fan coil unit.

According to a first aspect of the invention, there is provided an air conditioning system having: a heater unit providing a hot water flow and receiving a hot water return in hot water loop; a chiller unit providing a cold water flow and receiving a cold water return in a cold water loop; one or more air to water heat exchangers; and one or more control valves, each control valve associated with one of the air to water heat exchangers and arranged to: receive the hot water flow and cold water flow; selectively provide the flow from a one of the hot water loop or cold water loop to the air to water heat exchanger; receive a return from the air to water heat exchanger; and selectively provide the return from the air to water heat exchanger to the return of the one of the hot water loop or cold water loop.

The system removes all of the difficulties in installing the conventional water based system. Installation of the system is simple, cost effective, and has a single point of control and supply. This is because there is a single flow pipe to the heat exchanger, and a single return pipe from it.

The air conditioning system of the first aspect is designed to work with various existing systems which include water chillers, boilers, heat pumps and other water-based cooling and heating systems. The system can be used to convert a four-pipe system into an energy and cost saving two pipe system, with only two pipes leading to and from the air to water heat exchanger. The system of the first aspect can be utilised and integrated with any fan coil units, chilled beams, water chillers, heat pumps, dual heat and cooling water-based products. It can also be adapted to include two port systems, for countries where they do not need simultaneous heating and cooling, and operate in summer and winter seasons for heating and cooling.

The heater and chiller may be provided in a single combined unit, or as separate units. The air to water heat exchanger may comprise a fan coil unit, chilled beam, air-handling unit or other type of terminal units.

The air conditioning system may include two or more air to water heat exchangers; and two or more control valves, each control valve associated with one of the air to water heat-exchangers.

The system may comprise a changeover box. The changeover box may enclose at least some of the one or more control valves, and may be arranged to provide a connection between the hot and cold water flows and returns, and the one or more air to water heat exchangers. The changeover box may include a hot flow header arranged to provide the hot flow to the one or more control valves; a cold flow header arranged to provide the cold flow to the one or more control valves; a hot return header arranged to couple the hot return to the one or more control valves; and a cold return header arranged to couple cold return to the one or more control valves.

The changeover box may include a housing defining a volume receiving the control valves, the hot and cold flow headers, and the hot and cold return headers. The housing may include a dividing wall splitting the volume into a first chamber and a second chamber, separate from the first chamber. The first chamber may receive the control valves, the hot and cold flow headers, and the hot and cold return headers, and the second chamber may receive control electronics for operating the one or more control valves. The housing may include a first lid arranged to close the second chamber; and a second lid arranged to close the first chamber. The changeover box may include 2, 4, 6, 8, 12 or 16 valves, or any other combination of valves.

The changeover box may include a changeover box controller arranged to operate the control valves received in the changeover box, and the associated air to water heat exchangers. The changeover box controller may be arranged to: receive an input from a thermostatic controller, the input indicative of a desired temperature; and operate the one or more control valves and the air to water heat exchanger based on the received input.

Each of the one or more air to water heat exchangers may comprise a heat exchanger controller. The input from the thermostatic controller may be provided to the changeover box controller via the heat exchanger controller. The system may include one or more thermostatic controllers, each associated with a different air to water heat exchanger. The heat exchanger controllers and valve controller may be arranged such that each control valve and/or its associated air to water heat exchanger are separately controllable, to provide different temperatures in a vicinity of each air to water heat exchanger unit.

The air conditioning system may include: a first air to water heat exchanger having a first heat exchanger controller in connection with the changeover box controller via a first communications link; and a second air to water heat exchanger having a second heat exchanger controller in connection with the first heat exchanger controller via a second communications link, such that the second heat exchanger controller is in communication with the changeover box controller via the first and second communication link.

The air conditioning system may include two or more changeover boxes, each changeover box encasing at least one of the one or more control valves. Each changeover box may include a changeover box controller arranged to operate the control valves encased in the changeover box, and the associated air to water heat exchangers.

The air conditioning system may include a system controller arranged to control operation of the system. The system controller may be arranged to override the changeover box controllers. The system controller may also regulate a water flow in the system, via the six-way valve.

The system may include: a first changeover box having a first changeover box controller in communication with the system controller via a first control link; and a second changeover box having a second changeover box controller in communication with the first changeover box controller via a second control link, such that the second changeover box controller is in communication with the system controller via the first and second control link.

The system may include a first building header for supplying the hot water flow to the two or more changeover boxes; a second building header for supplying the cold water flow to the two or more changeover boxes; a third building header for receiving the hot water return from the two or more changeover boxes; and a fourth building header for receiving the cold water return from the two or more changeover boxes. Each of changeover boxes may be connected to the building headers by separate connections. The building headers may comprise pipes having a first diameter, and connections between the changeover boxes and the air to water heat exchangers may comprise pipes having a second diameter, smaller than the first diameter.

According to a second aspect of the invention, there is provided a changeover box for providing the system of the first aspect.

According to a third aspect of the invention, there is provided a changeover box arranged to be used in an air-conditioning system, the changeover box including: a first input arranged to receive a hot water flow; a first output arranged to provide a hot water return; a second input arranged to receive a cold water flow; a second output arranged to provide a cold water return; one or more third outputs, each arranged to provide flow to an air to water heat exchanger; one or more third inputs, each arranged to receive a return from an air to water heat exchanger; and a control valve associated with each pair of third inputs and outputs, each control valve arranged to: receive the flows from the first and second inputs; selectively provide the flow from a one of the first and second inputs to a one of the third outputs; and selectively provide the return from the one of the third inputs to the return of the one of the first and second outputs.

The changeover box allows an air conditioning system to be installed without the difficulties associated with installing a conventional water based system. Installation of an air conditioning system using the changeover box is simple, cost effective, and has a single point of control and supply. This is because there is a single flow pipe to the heat exchanger, and a single return pipe from it.

The changeover box is designed to work with various existing systems which include water chillers, boilers, heat pumps and other water-based cooling and heating systems. The changeover box can be used to convert a four-pipe system into an energy and cost saving two-pipe system, with only two pipes leading to and from the air to water heat exchanger. The changeover box can be utilised and integrated with any fan coil units, chilled beams, water chillers, heat pumps, dual heat and cooling water-based products.

The changeover box may include two or more valves. Each valve may be arranged to: receive the flows from the first and second inputs; selectively provide the flow from a one of the first and second inputs to the third output; and selectively provide the return from the third input to the return of the one of the first and second outputs. The changeover box may include 2, 4, 6, 8, 12 or 16 valves, or any other combination of valves.

The changeover box may have a first enclosure for receiving pipes and control valves, and a second enclosure for receiving control electronics for controlling operation of the control valves. The changeover box may include a first lid arranged to close the closure for electronics, and a second lid closing the closure for pipes.

According to a fourth aspect of the invention, there is provided a kit arranged to form the air conditioning system of the first aspect, the kit including: a changeover box according to the second or third aspect; a heater unit providing a hot water flow and receiving a hot water return in hot water loop; a chiller unit providing a cold water flow and receiving a cold water return in a cold water loop; and one or more air to water heat exchangers.

According to a fifth aspect of the invention, there is provided a method of adapting a water based air conditioning system, the method comprising fitting the changeover box of the second or third aspect to a cold water loop and hot water loop an air conditioning system.

The method allows a four-pipe system to be converted into an energy and cost saving two pipe system, with only two pipes leading to the air to water heat exchanger According to a further aspect, there is provided a four pipe to two pipe hot/cold water changeover box, arranged to convert a four pipe air conditioning system to a two pipe system.

The changeover box may be adapted to a two port system when simultaneous heating and cooling are not required. In this case, the valve is two port and the cycle of water from the pump to the chiller is reversed.

It will be appreciated that any feature discussed in relation to a particular aspect of the invention may be applied to any other aspect of the invention.

Embodiments of the invention will now be described, by way of example only, with reference to the Figures, in which:

FIG. 1 schematically illustrates an air conditioning system according to a first embodiment;

FIG. 2 schematically illustrates the valve of the system of FIG. 1;

FIG. 3 schematically illustrates the internal water connections in an embodiment of a changeover box (VWVK) including multiple valves;

FIG. 4 schematically illustrates the control system for the VWVK of FIG. 3;

FIG. 5 schematically illustrates an embodiment of an air conditioning system incorporating two VWVKs as shown in FIGS. 3 and 4;

FIG. 6 schematically illustrates the controls system for an embodiment of an air conditioning system incorporating the VWVK shown in FIGS. 3 and 4;

Figure 5:
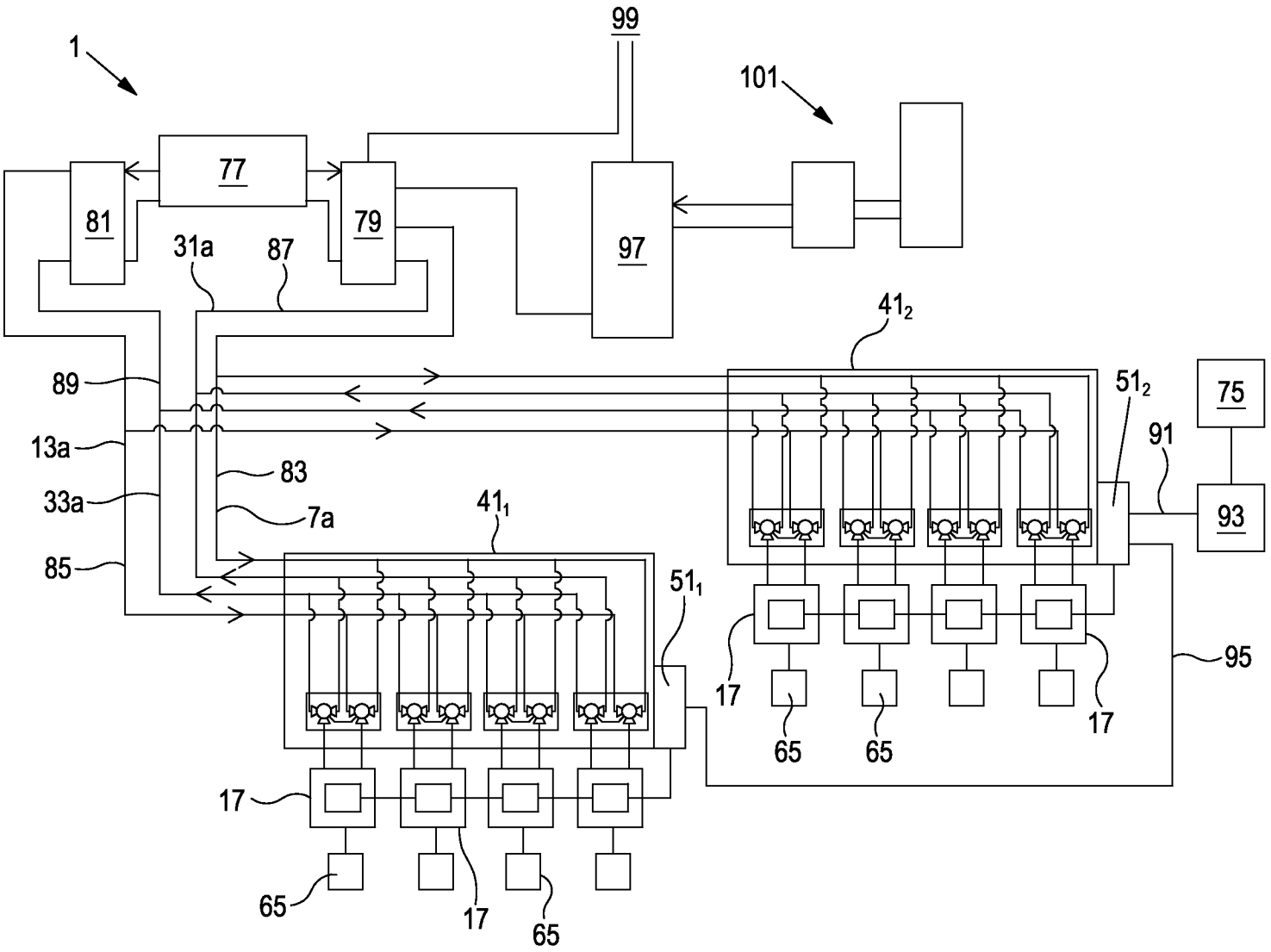
Figure 6:
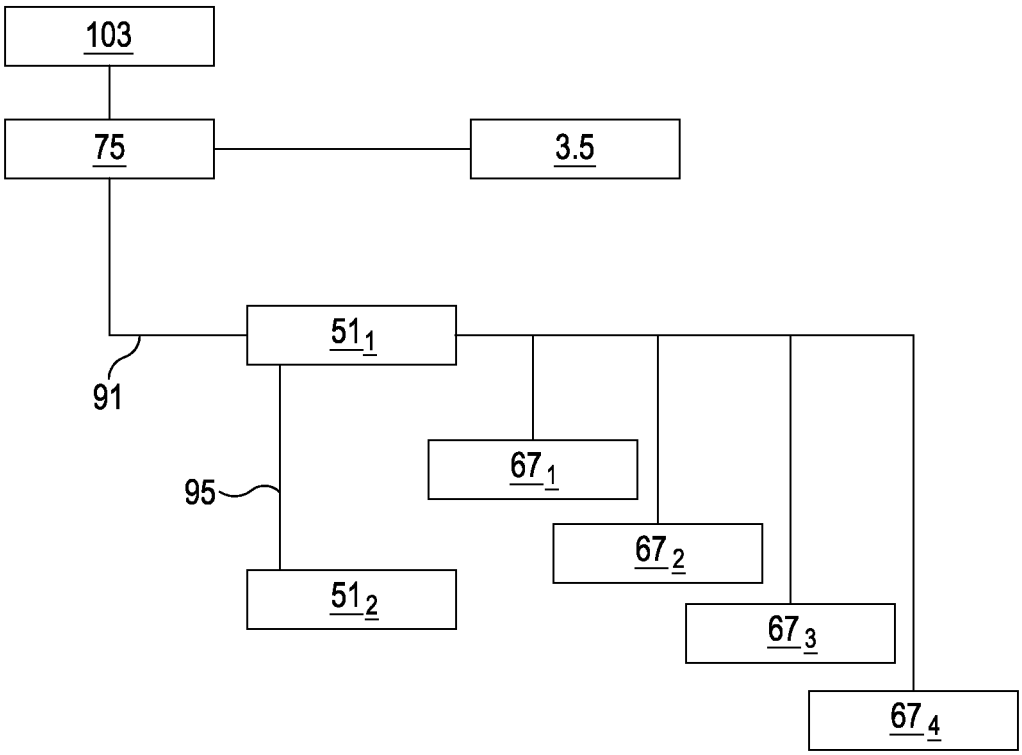
Figure 7A:
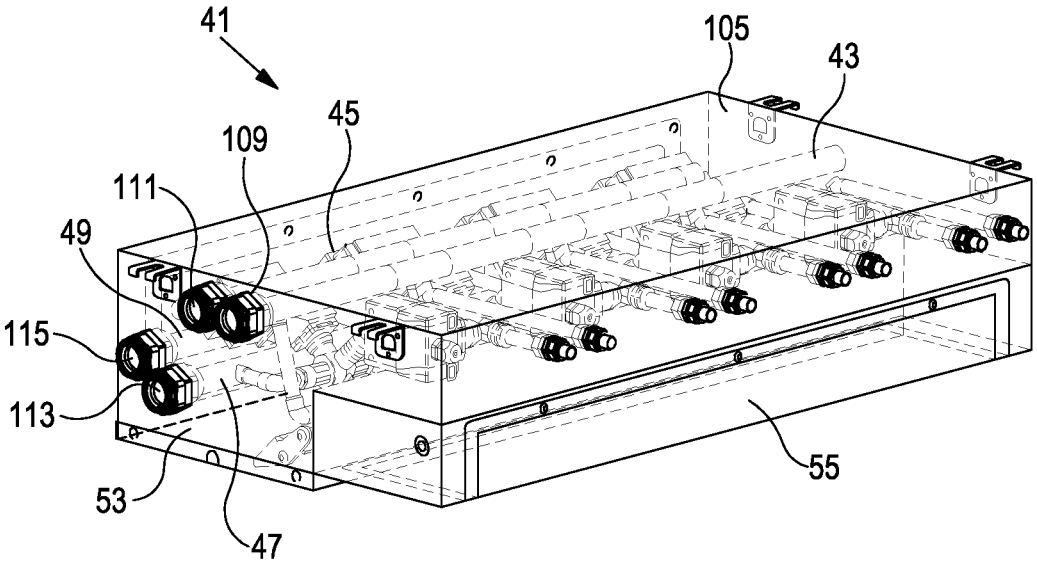
FIG. 7A illustrates a perspective view of an embodiment of a VWVK, showing the inner components.
Figure 7B:
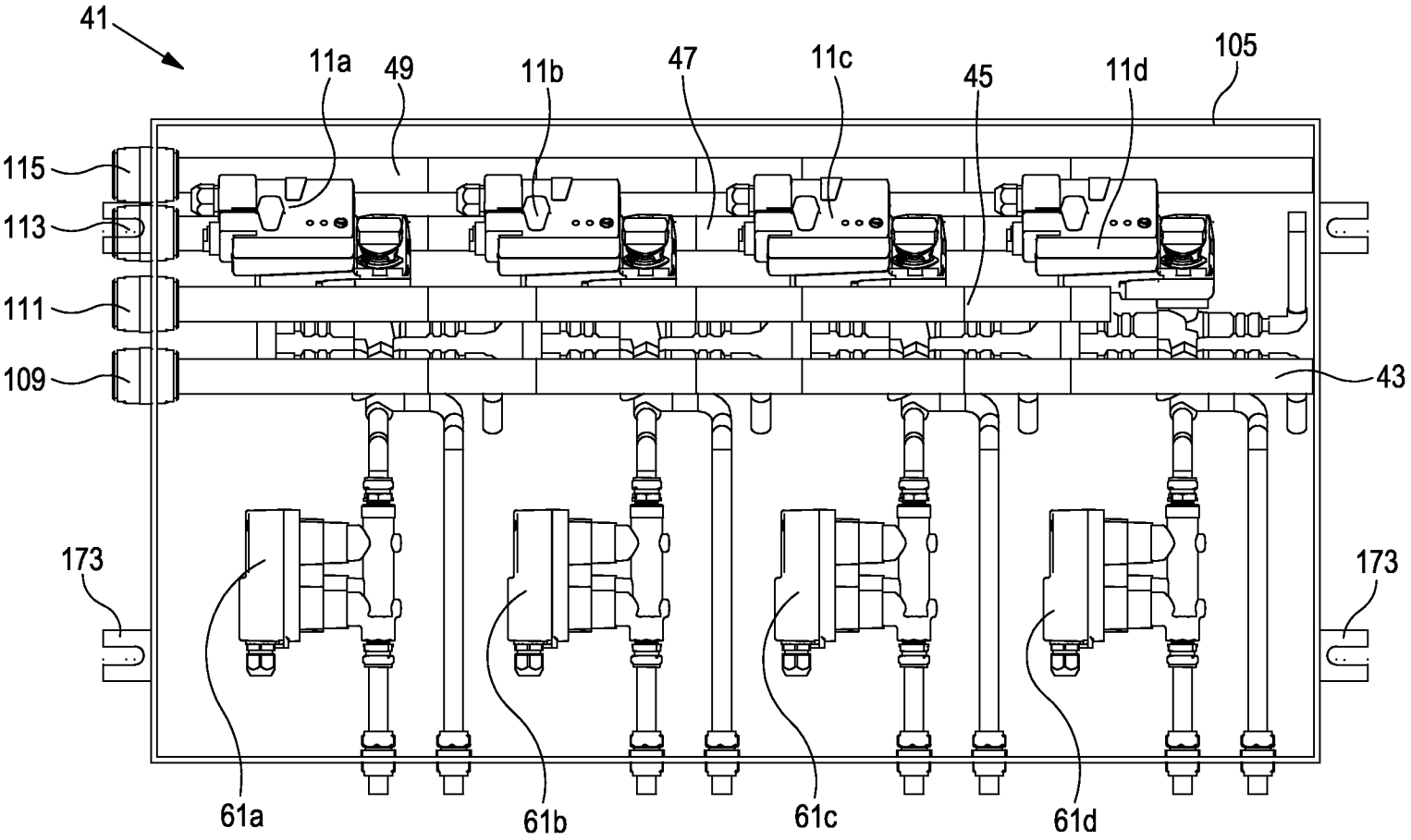
FIG. 7B illustrates the top view of the VWVK of FIG. 7A.
Figure 7C:
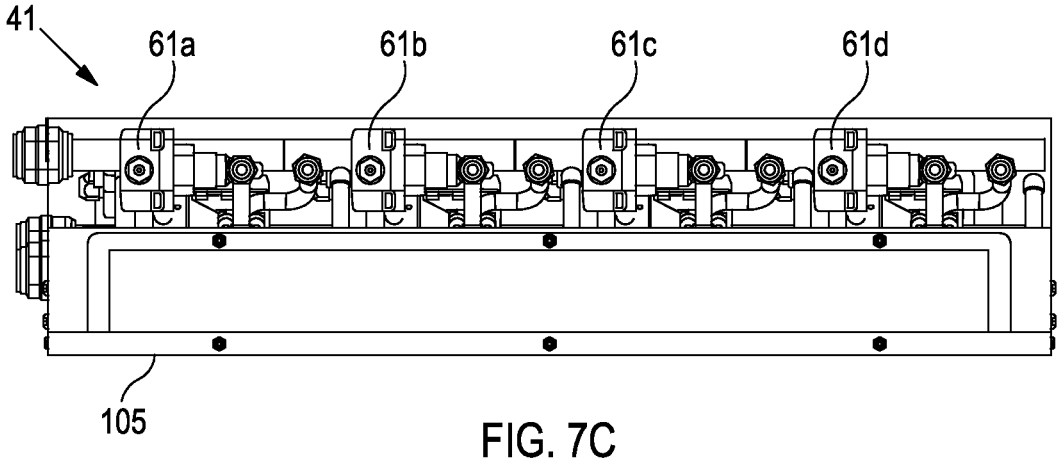
FIG. 7C illustrates the side view of the VWVK of FIG. 7A.
Figure 7D:
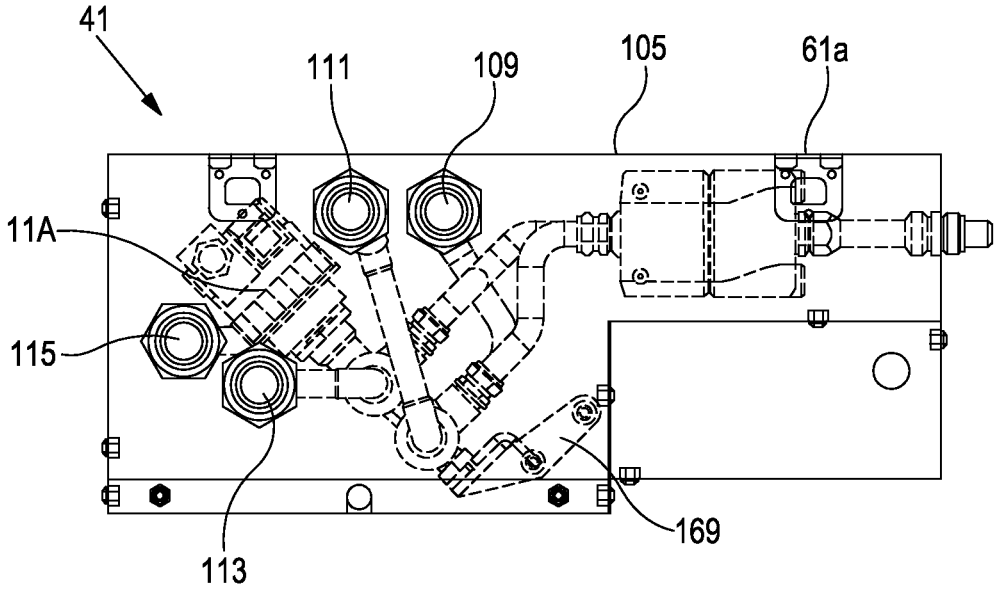
FIG. 7D illustrates the end view of the VWVK of FIG. 7A, from the end with the hot and cold inlet and outlet ports.
Figure 11:
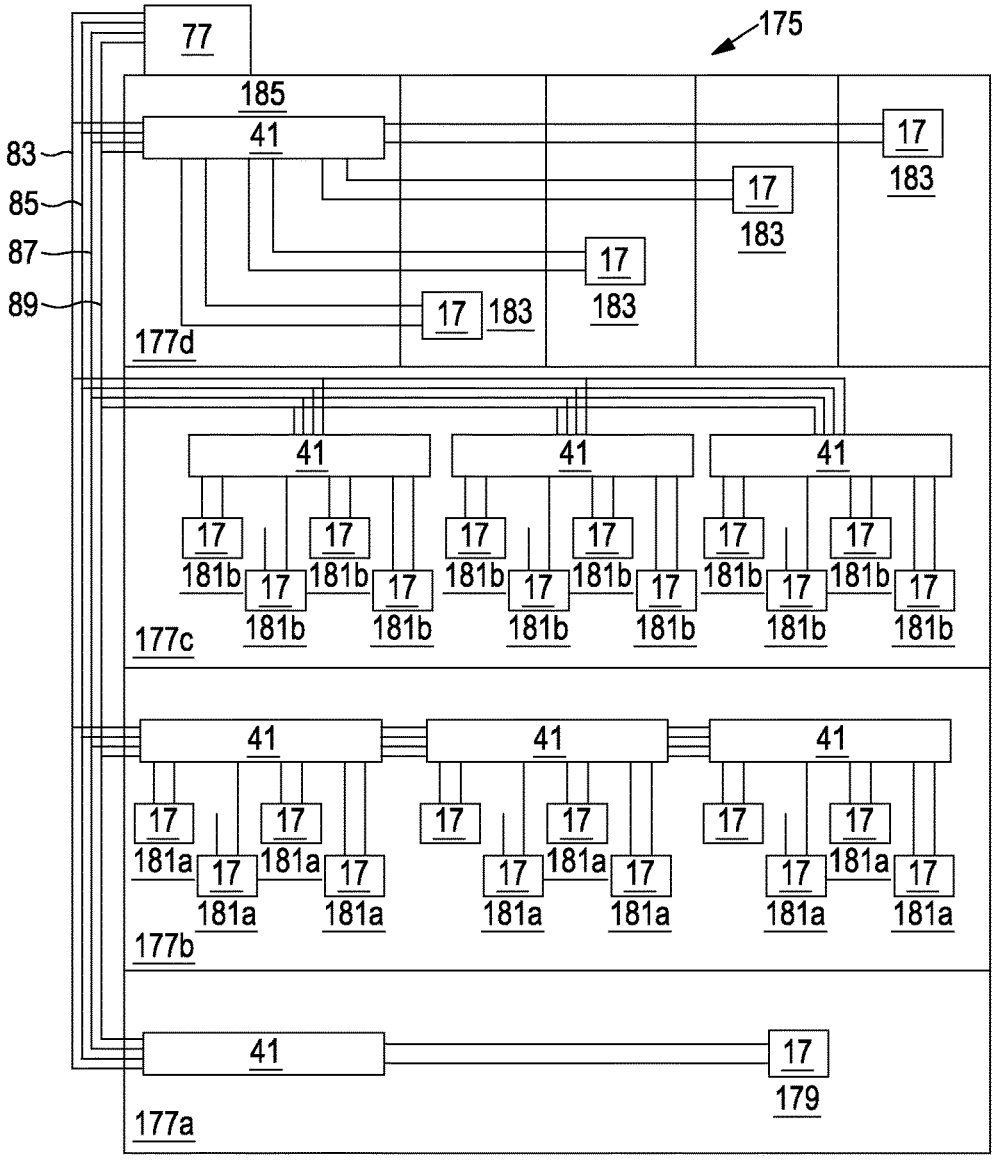
Figure 12A:
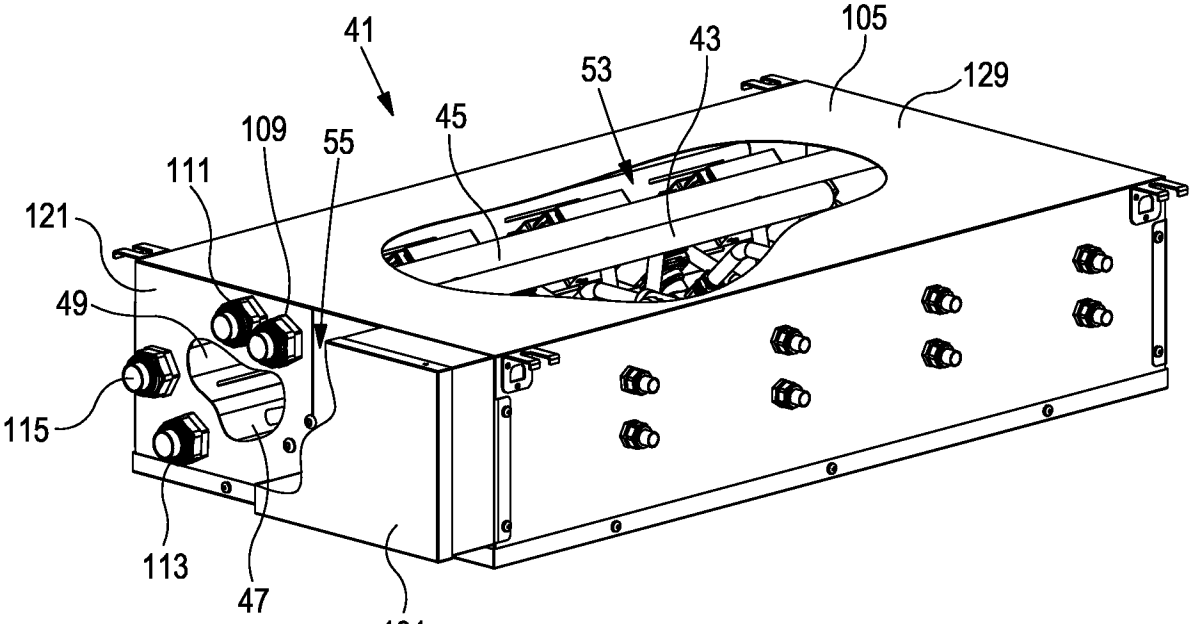
Figure 12B:
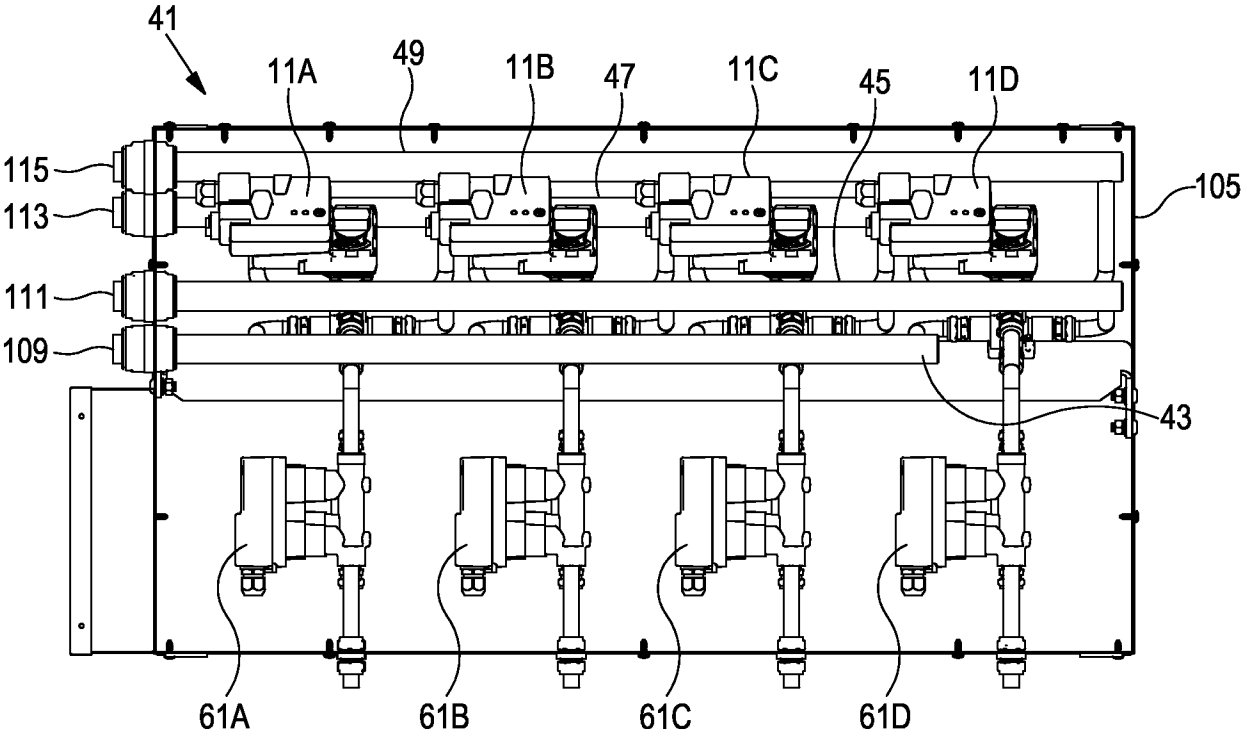
Figure 12C:
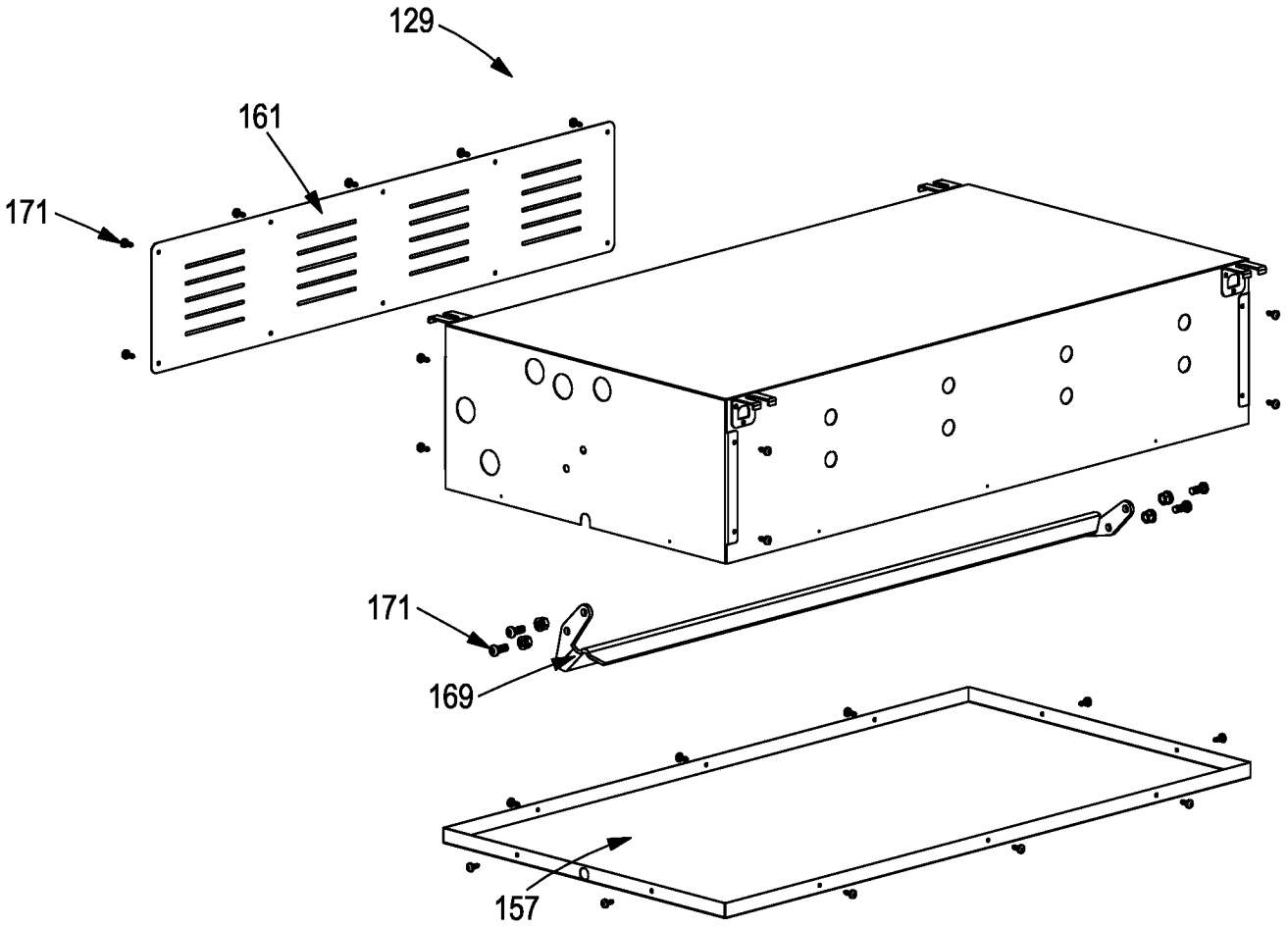

FIG. 11 schematically illustrates an example of a building include an air conditioning system shown in FIGS. 1 to 6; and FIGS. 12A to 12C illustrate an alternative embodiment of a casing for forming the VWVK of FIG. 7A.

Figure 1:
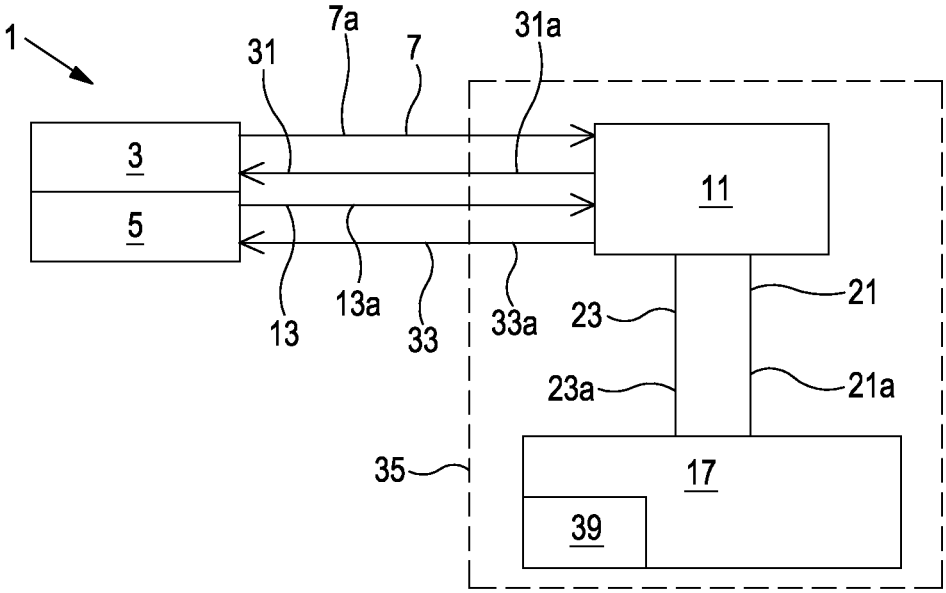
Figure 2:
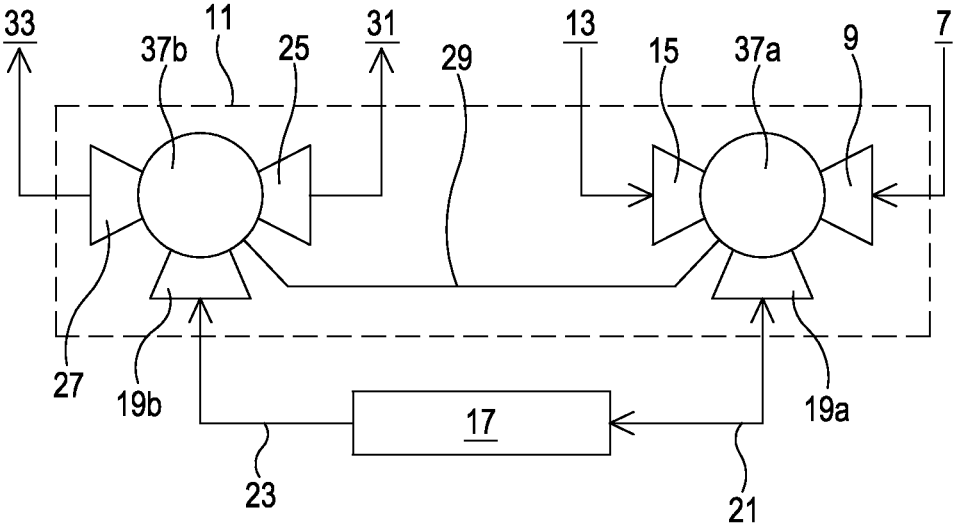

FIGS. 1 and 2 schematically illustrate an air conditioning system 1 according to a first embodiment, and a control valve 11 for operating the system 1. The air conditioning system 1 includes a heater 3 for heating water and a chiller 5 for cooling water. A hot flow 7 is directed by a pipe 7*a* from the heater 3 into a hot water input port 9 of a six way control valve 11, and a cold flow 13 is directed by a pipe 13*a* from the chiller 5 into a cold water input port 15 of the valve 11. The control valve 11 directs a flow 21 to a water to air heat exchanger 17 through a heat exchanger output port 19*a* of the valve 11 and a pipe 21*a*. The flow 21 may be either the hot flow 7 or cold flow 13, depending on the load requirement of the area 35. The heat exchanger 17 provides a return 23 into a heat exchanger input port 19*b* of the valve 11, through a pipe 23*a*.

The valve 11 has a hot water outlet port 25 and a cold water outlet port 27. When the hot water flow 7 is directed to the heat exchanger 17, the heat exchanger return 23 is provided at the hot water outlet port 25. When the cold water flow 13 is directed to the heat exchanger 17, the heat exchanger return 23 is provided to the cold water outlet port 27. A hot water return 31 and cold water return 33 are provided back to the heater 3 and chiller 5 by respective pipes 31*a*, 33*a*.

It will be appreciated that the hot water flow 7 and hot water return 31 form part of a hot water loop around which hot water is circulated to and from the heater 3. Similarly, the cold water flow 13 and cold water return 33 form part of a cold water loop around which cold water is circulated to and from the chiller 5. By operation of the valve 11, the flow 21 to the heat exchanger 17 and return 23 from the heat exchanger 17 completes one of the hot and cold water loop.

As will be discussed below in more detail, in some, but not all, examples, the hot water loop and cold water loop include return connections (not shown) to connect the hot water flow 7 to the hot water return 31, and the cold water flow 13 to the cold water return 33. This ensures that whichever of the flows loops is not completed through the heat exchanger is still circulated through the building.

In one example the hot water flow 7 as it leaves the heater 3 may be 45 degrees Centigrade, and the hot water return 31 as it arrives back at the heater 3 may be 40 degrees Centigrade. In this example, the cold water flow 13 as it leaves the chiller may be 7 degrees Centigrade and the cold water return as it returns to the chiller may be 12 degrees Centigrade.

Using the above system 1, the control valve 11 can control the temperature of an area 35 (in combination with control of the heater 3 and/or chiller 5), by controlling whether hot water or cold water is fed to the heat exchanger 17. The heat exchanger 17 provides either heat from hot water into the area 35, or transfers heat from the area 35 to cold water.

The control valve 11 may include two three port valves 37*a,b*. A first three port valve 37*a* receives the hot water flow 7 and cold water flow 13, and provides the heat exchanger flow 21. A second three port valve 37*b* and receives the heat exchanger return 23, and provides the hot water return 31 and the cold water return 33.

It will be appreciated that any water to air heat exchanger 17 may be used. The heat exchanger 17 may also include circulating means 39 to circulate the air in the vicinity of the heat exchanger 17, such as a fan. For example, the heat exchanger 17 may be a fan coil unit (FCU), such as a Samsung eZP-440R4-230 Fan Coil Unit. Alternatively, the heat exchanger 17 may be a chilled beam device.

In some embodiments, the valve 11 may have two modes of operation—a first in which the hot water flow 7 is provided to the heat exchanger 17 and a second in which the cold water flow 13 is provided to the heat exchanger. In other embodiments, the valve 11 may have a third mode, referred to as an off mode. In such embodiments, no flow is provided to the heat exchanger 17. A pressure relief bypass 29 is provided in the valve 11, between the hot water loop and the cold water loop. This is provided to ensure a pressure balancing mechanisms between the hot and cold flows 7, 13.

The arrangement of the valve 11 discussed above is given by way of example only. It will be appreciated that any suitable valve 11 may be used to control the flow provided to the heat exchanger 17.

Any suitable heater 3 and chiller 5 may also be used. In some examples, the heater 3 and chiller 5 may be provided in a single combined unit, such as a heat recovery chiller unit. Alternatively, the heater 3 and chiller 5 may be provided as separate units.

The valve 11 may be inside or outside the space 35 to be heated or cooled. Furthermore, the pipes 7*a*, 13*a*, 31*a*, 33*a* between the heater 3 and chiller 5, and the valve 11 may be partially or wholly inside or outside the space 35 to be heated or cooled. The pipes 21*a*, 23*a* between the valve 11 and the heat exchanger 17 may pass through the space 35 to be cooled or heated, or outside it.

In some examples, the system 1 may include only a single valve 11 and heat exchanger 17, as discussed above. Alternatively, the system 1 may include multiple heat exchangers 17. Each heat exchanger 17 may be associated with a separate control valve 11. This allows different regions of the area to be heated or cooled 35 to be set at different temperatures. Alternatively, multiple heat exchangers 17 may be fed, in series or parallel, from a single control valve 11.

Figure 3:
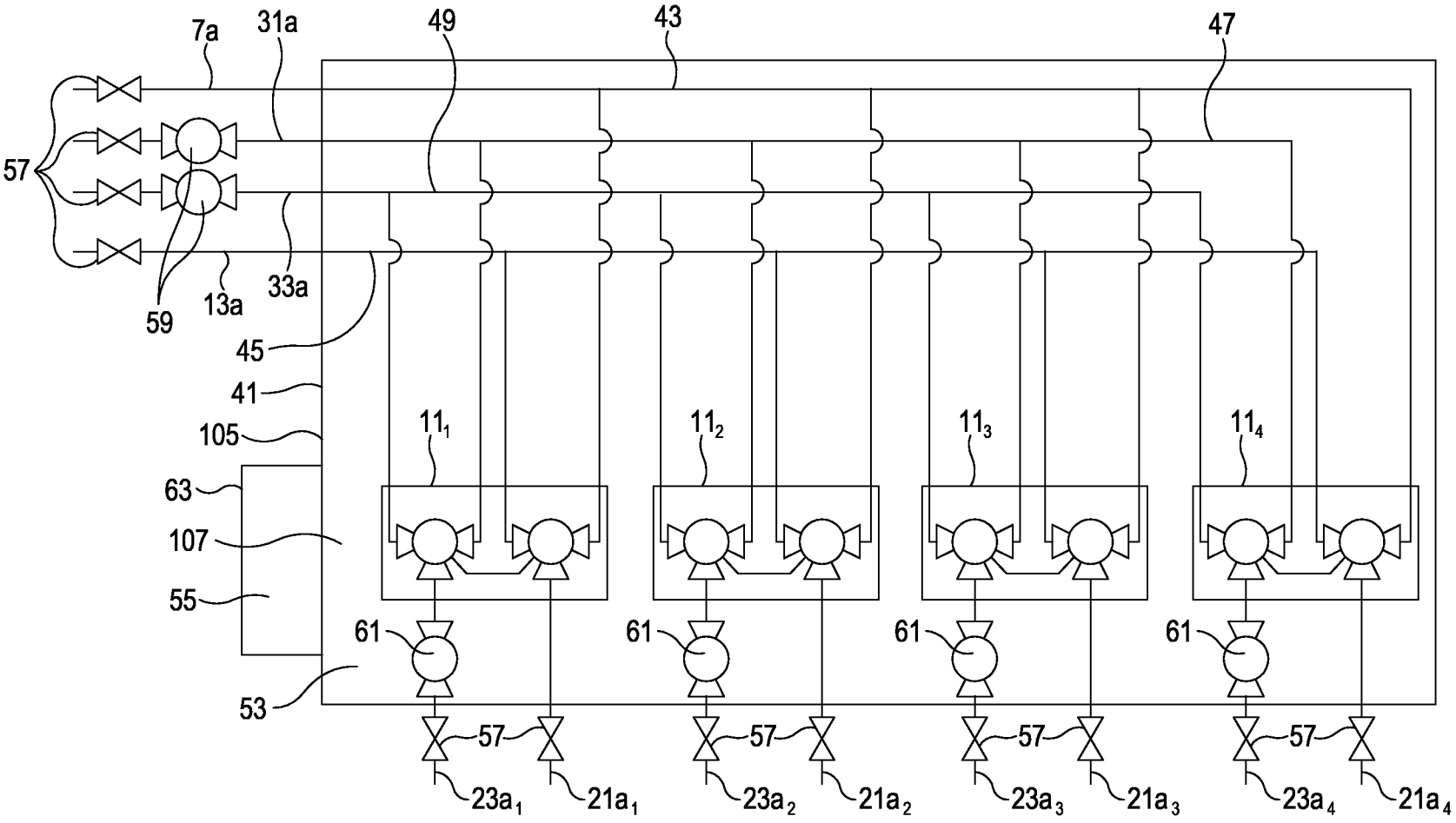
Figure 4:
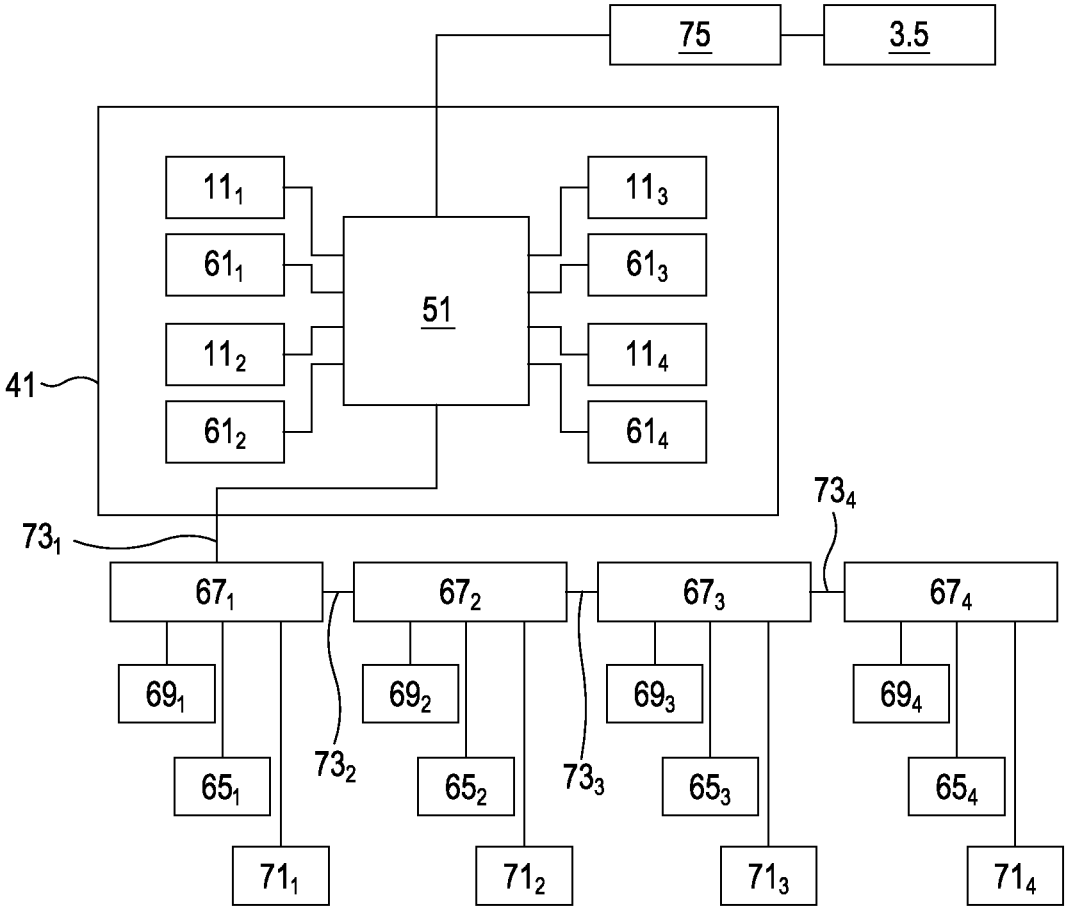

In systems 1 with one valve 11, the valve 11 may be received in an enclosure 41 referred to as a changeover box (VWVK). In systems 1 with more than one valve 11, there may be one or more VWVKs 41, and each VWVK 41 may include one or more valve 11. FIGS. 3 and 4 illustrate an example of a VWVK 41 having four control valves 11, each associated with a single separate heat exchanger 17. FIGS. 5 and 6 illustrate an example of a system 1 including multiple VWVKs 41, each having four control valves 11, each associated with a single separate heat exchanger 17.

FIG. 3 illustrates the fluid connections within the VWVK 41 having four control valves $\mathbf{11}_{1\text{-}4}$. The VWVK is formed by a casing 105 defining an enclosure 53 for receiving the valves 11. The casing 105 will be discussed in more detail below.

Through a header system 43, 45, 49 the hot and cold water loops are connected to the control valves 11. The header system 43, 45, 47, 49 includes a hot water flow header 43 and a cold water flow header 45 for providing the hot water flow 7 and cold water flow 13 to each of the control valves 11. The header system 43, 45, 47, 49 also includes a hot water return header 47 and a cold water return header 49 to take the hot return flow 31 and cold return flow 33 from each of the control valves 11. From each valve 11, flow and return pipework 21*a*, 23*a* exits through the casing 105, and is connected to an air to water heat exchanger 17. All components within the VWVK 41 may be insulated.

Isolating valves 57 are provided on each separate flow and return pipe 7*a*, 13*a*, 21*a*, 23*a*, 31*a*, 33*a* in the system 1, to allow the respective pipework to be shut off and isolated. Commissioning valves 59 are also provided on the hot water return pipe 31*a* and cold water return pipe 33*a*. In addition, a flow sensor $\mathbf{61}_{1\text{-}4}$ is provided on the return pipe 23*a* to each control valve 11. The flow sensors 61 monitor the flow through the valve 11. This in turn allows the pressure in the system to be determined. The control valves 11 and flow sensors 61 are received in the VWVK casing 105. The other commissioning valves 59, and isolation valves 57 may be provided externally of the VWVK 41.

The control valves 11 are pre-assembled in a VWVK 41, connected using a suitable material (copper, plastic aluminium or steel). The control valves 11, flow sensors 61 and headers 43, 45, 47, 49 are received in a first enclosure 53 in the VWVK 41. The valves 11 are prewired to a VWVK control panel 51 located within a separate enclosure 55 defined by the casing 105 of the VWVK 41.

Different VWVKs 41 can be used for different heating and cooling requirements. This gives modular flexibility dependant on the building requirements. Each control valve 11 has an operating range which, in one example, shall be as follows:

Water temperature 6 to 80° C.

Flow rate 0.05-0.351/s (15 mm valve)

Capacity rate KW-1.25 KW-7.5 KW

Flow rate 0.167-0.651/s (20 mm valve)

Capacity rating KW-4.18 KW-12 KW

Depending on the desired flow rates, the headers 43, 45, 47, 49 and pipes 21*a*, 23*a* to and from the heat exchanger 17 may be varied in diameter. In one example, the diameter may be 15 mm, in another example, the diameter may be 20 mm. The heating/cooling capacity of a VWVK 41 for such examples is given by:

| Number of valves | 15 mm valves | 20 mm valves |
|---|---|---|
| 4 | 1.25-30 kw | 4.18-48 kw |
| 6 | 1.25-45 kw | 4.18-72 kw |
| 8 | 1.25-60 kw | 4.18-96 kw |

The pressure drop in the VWVK is in the range of 0 kpa-71 kpa

Dependant on the requirement of the space 35 to be heated or cooled, a mode of operating each valve 11 will be selected. The mode of each control valve 11 can be cooling, heating or valve off, as discussed above.

In each VWVK 41 there is a control panel 63. The panel 63 contains the programmable controller 51 with bespoke software. For example, the controller 51 may be a DSC-1146E controller. The controller 51 will give 0-10 V signals to each control valve 11 based on the heating/cooling requirement, dictated by thermostatic controllers 65 located within the air to water heat exchanger 17. The voltage determines the operating mode of the valve 11. The controller 51 may have an LED display.

In one example, 0-3 V may be used for cooling (i.e. directing cold water flow 13 to heat exchanger 17), 4-7 V for a dead band (i.e. off mode) and 8-10 v for heating (i.e. directing hot water flow 7 to the heat exchanger 17). In an alternative example, 2-4.7 V may be used for cooling, 4.7-7.3 for the dead band, and 7.3-10 for heating.

The voltage given will modulate the six-port control valve 11 to vary the flow of water to the heat exchanger 17, providing precise control. At the same time, the controller 51 will monitor the pressure within the system 1 using the flow sensors 61 and modulate the control valve 11, supplied and fitted within the VWVK 41 to the flow through the system to accommodate pressure variations in the system 1.

The VWVK 41 may require a 5 amps single phase power supply, compliant with any relevant regulations, although any other suitable power supply may be used.

Each heat exchanger 17 is fitted with a control panel, within this control panel will be a mains power supply and a PCB (also referred to as a controller 67). The controller 67 may be, for example, a Samsung Mim card. The controller 67 can accept a remote thermostatic controller 65. For air to water heat exchangers incorporating fan, such as a fan control unit, the controller 67 may also control a fan motor 0-10v control 69 (EC type motors). The controller 67 may also recieve input from sensors 71 such as return air sensor, remote contact for PIR or door interlock, and a float switch.

Each heat exchanger controller 67 has a different identifier. Via 2-core wiring each heat exchanger controller 67 can communicate with the VWVK controller 51 which will give signals to control the valves 11 and fan motor 69, making adjustment to give precise control.

Control communications between the VWVK controller 51 and the heat exchanger controllers 67 may be via 2 core 0.75 mm screen comms cable. This can then be supplied to a number of heat exchangers 17, and may be daisy chained around the heat exchangers 17.

FIG. 4 illustrates the control communications between a single VWVK 41 having four control valves $\mathbf{11}_{1\text{-}4}$ and the controllers 67 of the associated heat exchangers 17.

Within the VWVK 41, the controller 51 controls operation of the control valves $\mathbf{11}_{1\text{-}4}$ and flow sensor $\mathbf{61}_{1\text{-}4}$.

As discussed above, each heat exchanger controller 67 is also in communication with a motor 69 associated with the heat exchanger 17, a thermostatic controller 65, and the sensors 71. This communication may also be via 2-core wiring.

As shown in FIG. 4 the controller $\mathbf{67}_1$ of a first heat exchanger $\mathbf{17}_1$ is in direct communication with the controller 51 of the VWVK 41 via a first communication link $\mathbf{73}_1$. The controller 672 of a second heat exchanger $\mathbf{67}_2$ is in communication with the controller $\mathbf{67}_1$ of the first heat exchanger $\mathbf{17}_1$ over a second communication link $\mathbf{73}_2$. The controller $\mathbf{67}_3$ of a third heat exchanger $\mathbf{67}_3$ is in communication with the controller $\mathbf{67}_2$ of the second heat exchanger $\mathbf{17}_2$ over a third communication link $\mathbf{73}_3$. The controller $\mathbf{67}_4$ of a fourth heat exchanger $\mathbf{67}_4$ is in communication with the controller 673 of the third heat exchanger $\mathbf{17}_3$ over a fourth communication link $\mathbf{73}_4$.

Although only the first heat exchanger $\mathbf{17}_1$ is in direct communication with the controller 51 of the VWVK 41, all heat exchange controller 67 can be addressed separately using the associated identifier. For example, the controller $\mathbf{67}_1$ of the first heat exchanger $\mathbf{17}_1$ may control the first heat exchanger $\mathbf{17}_1$ based on commands addressed to the first heat exchanger $17_1$, and may forward commands addressed to the other heat exchangers $17_{2-4}$.

The thermostatic controller 65 measures the temperature in the area around the output from the heat exchanger 17. Based on this measurement, and a pre-determined desired temperature, the VWVK controller 51 and heat exchanger controllers $67_{1-4}$ can provide control of the temperature, to bring the measured temperature to the desired temperature.

The desired temperature can be set through a system controller 75, in communication with the VWVK controller 51. Alternatively, the thermostatic controller 65 may allow for setting of the desired temperature. In some examples, the desired temperature may be set through the system controller 75 or the thermostatic controller 65, although the system controller 75 may be able to override the thermostatic controller 65.

The system controller 75 can also receive feedback to allow monitoring of the operating parameters of the VWVK 41 and heat exchangers 17, and may provide for fault detection. The system controller 75 may be accessible through a building management system 103. Faults may be indicated on the system controller 75, the building management system 130, or local thermostatic controllers 65. Common faults may include, for example, a dirty filter in the heat exchanger unit 17.

The system controller 75 may be an intelligent touch screen controller, connected to the VWVKs 41 via BACNET. For example, the system controller 75 may be a Delta eTCH-7ET-WEB touchscreen controller, communicating via a BACNET gateway 93. The system controller 75 can read a number of control valves 11 and make changes to individual heat exchangers 17, as discussed above.

In the example discussed above, each heat exchanger 17 is provided with a separate thermostatic controller 65, such that the area around each heat exchanger 17 can be heated or cooled to a different temperature. However, this is not necessarily the case. In some examples, two or more heat exchangers 17 may control the temperature of a single area, and so only a single thermostatic controller 65 is provided. In this case, the heat exchanger 17 and valves 11 feeding the heat exchangers 17 may be operated in in the same manner.

FIG. 5 illustrates a system 1 including two VWVKs 41, each with four control valves 11, and four heat exchanger units 17. Each heat exchanger unit 17 is associated with a thermostatic controller 65.

In this example the heater unit 3 and chiller unit 5 are provided in a single system 77, such as an Omicron Rev S4. Hot water is fed from the heater-chiller system 77 to a first tank 79 and cold water is fed to a second tank 81. The first tank 79 provides hot water for the hot water flow 7 and the second tank provides cold water for the cold water flow 13. The hot water return 31 is fed back to the first tank 79, which is also connected to the heater-chiller system 77. Similarly, the cold water return 33 is fed back to the second tank 81, which is connected to the heater-chiller system 77.

The first tank 79 may also feed a hot water tank 97 of a building in which the system 1 is incorporated. The hot water tank 97 may provide hot water to sinks, showers and the like 99, and may also be coupled to a Samsung High Temperature heat exchanger and VRF condenser unit 101. The Samsung High Temperature heat exchanger and VRF condenser unit 101 provides additional heating to the hot water tank, to ensure that the water temperature stays above a minimum threshold temperature to avoid bacteria and the like. Any other suitable heat boosting system may be used.

Building headers 83, 85, 87, 89 provide for connection of the hot flow 7 and hot return 31 and the cold flow 13 and cold return 33 between the heater-chiller system 77 and the VWVKs 41. The building headers 83, 85, 87, 89 may include return connections to complete the hot and cold water loops, to ensure that both loops are completed and water is circulated, even when all valves 11 are in in the same mode (i.e. hot or cold) or in the off position. Instead of or as well as this, any branches from the building headers 83, 85, 87, 89 may include return connections.

A first VWVK $41_1$ is connected to the hot flow 7 and hot return 31 and the cold flow 13 and cold return 33. The first VWVK $41_1$ has a controller $51_1$, which is connected to the controllers 47 of the heat exchangers 17 as discussed above.

The second VWVK 412 is also connected to the hot flow 7 and return 31 and the cold flow 13 and return 33, on a separate branch to the first VWVK $41_1$. In other examples, each VWVK 41 may be connected in series, such that the headers 43, 45, 47, 49 continue through the VWVK 41.

The second VWVK $41_2$ has a controller $51_2$. As shown in FIG. 5, the controller $51_2$ of the second VWVK $41_2$ is in direct communication with the system controller 75 over a first control link 91, including a gateway 93. The controller $51_1$ of the first VWVK $41_1$ is in direct communication with the controller $51_2$ of the second VWVK $41_2$ via a second control link 95. It will be appreciated that the system shown in FIG. 5 can be scaled to include any number of VWVKs 41.

Each VWVK controller 51 has a different identifier. Only the controller $51_2$ of the second VWVK $41_2$ is in direct communication with the system controller 75. The controller $51_1$ of the first VWVK $41_1$ is in communication via the second VWVK $41_2$. Therefore, the VWVKs 41 can are controlled using their identifiers, in a similar manner to the air to water heat exchangers 17.

Where multiple VWVK are used, these may also be linked via a 2-core comms cable so all boxes can communicate on the system.

FIG. 6 illustrates an example of the connection of the system controller 75 to the controller $51_1$ of a first VWVK $41_1$, and the heat exchanger controllers $67_{1-4}$, and the connection of the controller $51_1$ of the first VWVK $41_1$ to the controller $51_2$ of a second VWVK $41_2$.

The system controller 75 shall be able to control or read the following functions

- Timer functions with built in 7-day timer
- External devices (such as chiller run and fault signals)
- Mode setting of each fan coil to include Auto, Heating, Cooling or fan only (where fan only mode corresponds to the valve off mode discussed above)
- Temperature settings—adjustable within certain parameter
- Fault indications
- Fan speeds Auto, low medium, high
- Filter dirty indication
- Group or Zone control The thermostatic controller 65 reads the temperature in order to control the valves 11 and heat exchangers 17. As a further option, the thermostatic controller 65 may have the following functions for local operation.

1) Mode setting of each fan coil to include Auto, Heating, Cooling or fan only
2) Temperature settings—adjustable within certain parameter (by way of example—between 18 to 24 degrees centigrade)
3) Fan speeds Auto, low medium, high.
4) Timer functions with built in 7-day timer
5) Built in remote sensor
6) Backlight 7) Locking/removing of operations 8) Fascia options (louver control)

An example of the construction of a VWVK 41, incorporating four control valves 11, will now be discussed, by way of example only, with reference to FIGS. 7A to 10F. It will be appreciated that the same construction may be scaled to include any number of control valves 11. It will also be appreciated that any dimensions on FIGS. 7A to 10F are purely by way of example only, and are not intended to be limiting. The VWVK 41 may be configured with connectivity for 4, 6, 8, 12, or 16 heat exchangers 17 (i.e. 4, 6, 8, 12, 16 control valves 11), but is not limited to these. The or each control valve(s) 11 may be configured to provide connectivity for multiple heat exchangers 17. In one example, each control valve 11 may be configured with connectivity for up to four heat exchangers 17. In this way, the VWVK 41 may, for example, incorporate four control valves 11, and 16 heat exchangers 17. The heat exchangers 17 connected to the same control valve 11 may be connected in series on a single loop, or they may be connected to the control valve 11 by two or more separate branches.

As discussed above, the VWVK 41 is formed by a casing 105 (or housing). The casing 105 is substantially cuboid in shape, having a rectangular base 117 and top 119 defining a length and width of the VWVK 41. End walls 121, 123 extend across the width and sidewalls 125, 127 extend along the length, between the base 117 and top 119. The casing 105 defines an internal volume 107 for receiving the components of the VWVK 41. The internal volume 107 is split into the first and second chambers 53, 55, as discussed above.

The casing 105 defines an inlet port 109 for coupling the hot flow 7 to the hot water flow header 43, and an inlet port 111 for coupling the cold water flow 13 to the cold flow header 45. Similarly, outlet ports 113, 115 are provided for the hot and cold returns 31, 33 respectively. The ports 111, 113, 115, 117 are defined in one of the end walls 121 of the casing 105.

In one example, the headers 43, 45, 47, 49 terminate within the casing 105. Alternatively, in other examples, where the hot and cold water flows and returns 7*a*, 13*a*, 31*a*, 33*a* are needed to continue after the VWVK 41, both end walls 121, 123 may include openings to connect to flow and return pipes 7*a*, 13*a*, 31*a*, 33*a*. Outlet 165 and inlet 167 ports are also provided for flow 21*a* and return 23*a* to the heat exchangers 17, in the second sidewall 127.

The casing 105 may be made from 0.6 mm galvanised steel, such as s275 mild steel or similar. However, any suitable material may be used. Although the VWVK 41 shown is configured initially for horizontal configuration, it is not limited to this.

FIGS. 7A to 7D illustrate the VWVK 41 with the casing 105 transparent, such that the internal components can be seen. FIGS. 8A to 8D illustrate the casing 105 on its own.

Figure 8A:
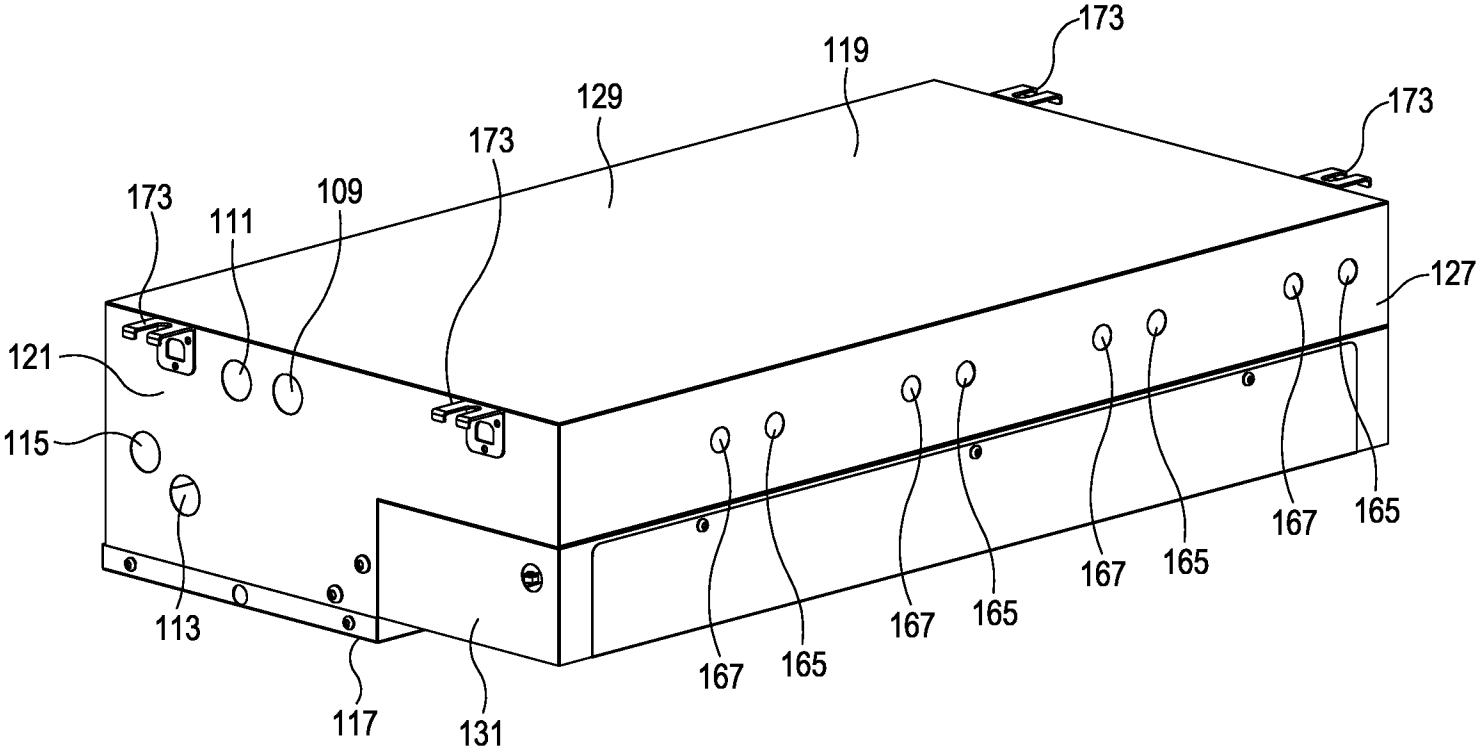
FIG. 8A illustrates an embodiment of a casing for forming the VWVK of FIG. 7A in perspective view.
Figure 8B:
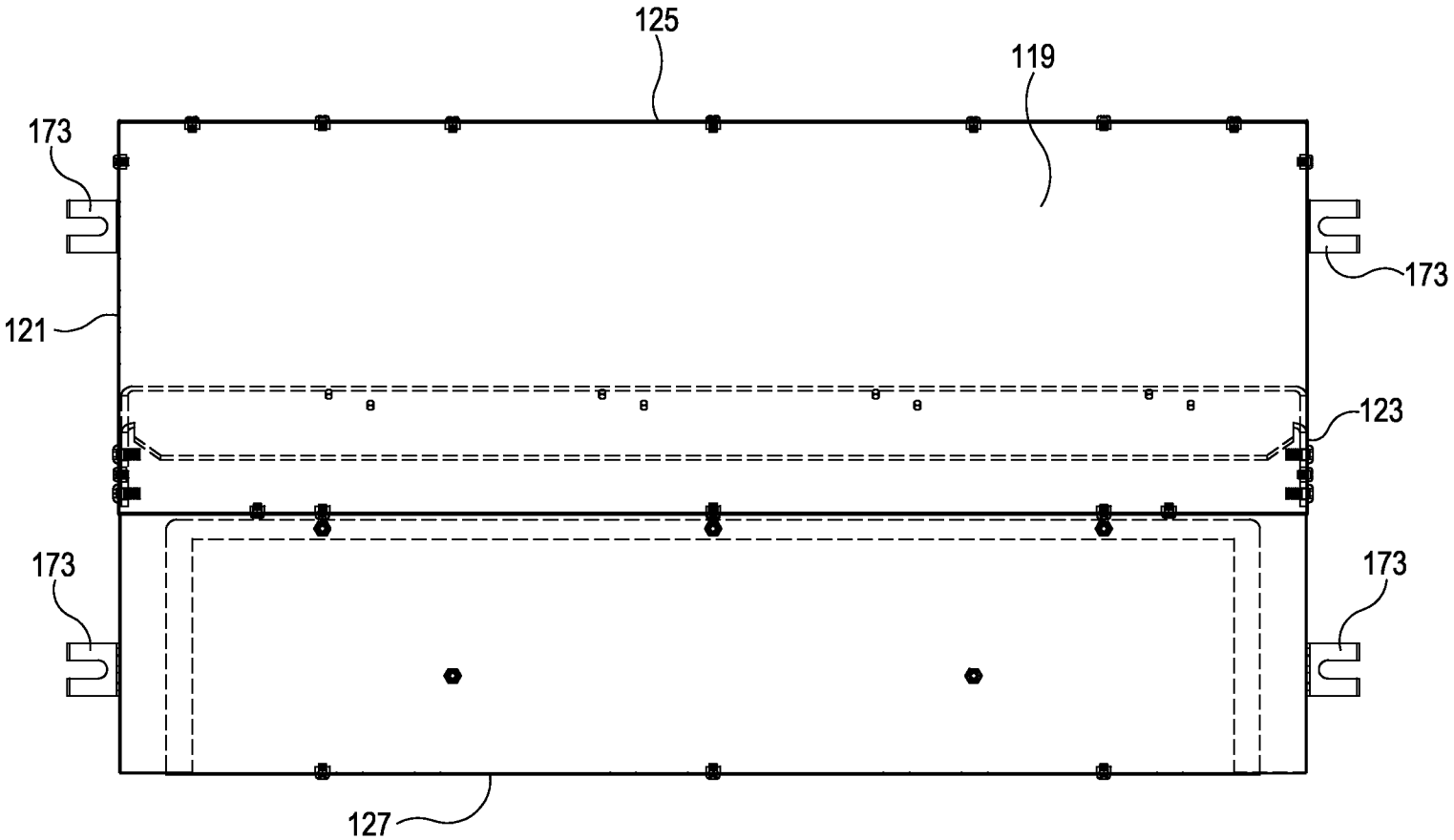
FIG. 8B illustrates the casing of FIG. 8A in top view.
Figure 8C:
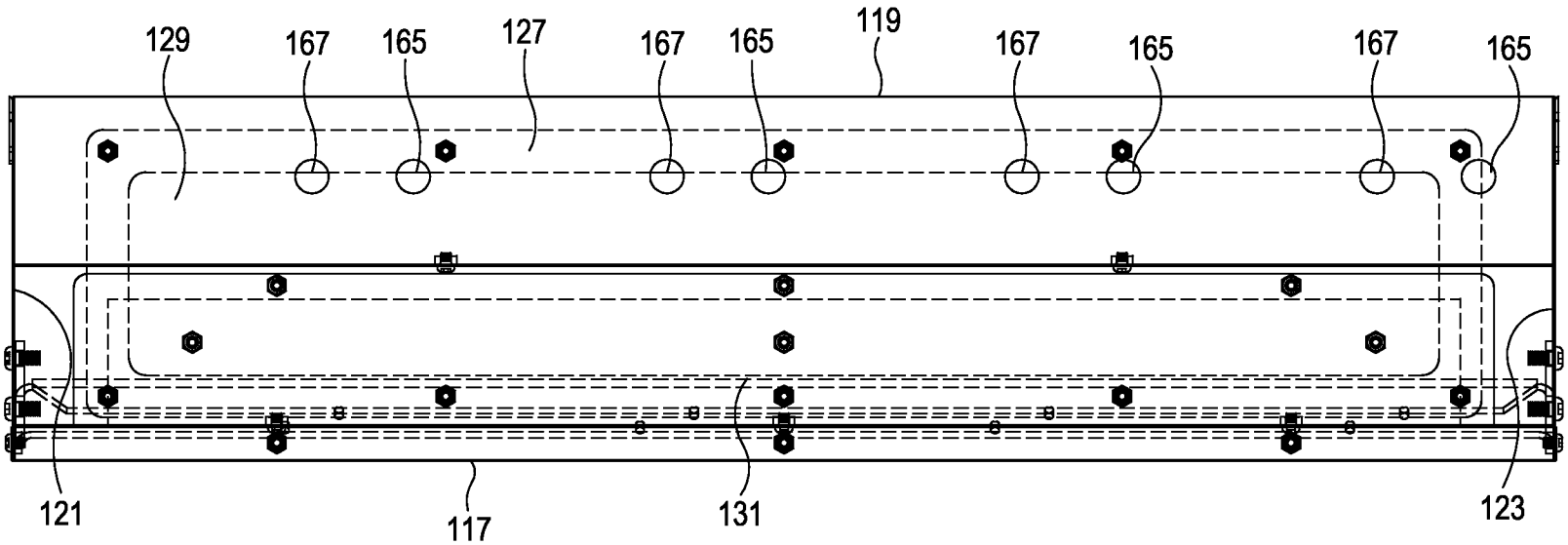
FIG. 8C illustrates the casing of FIG. 8A in side view.
Figure 8D:
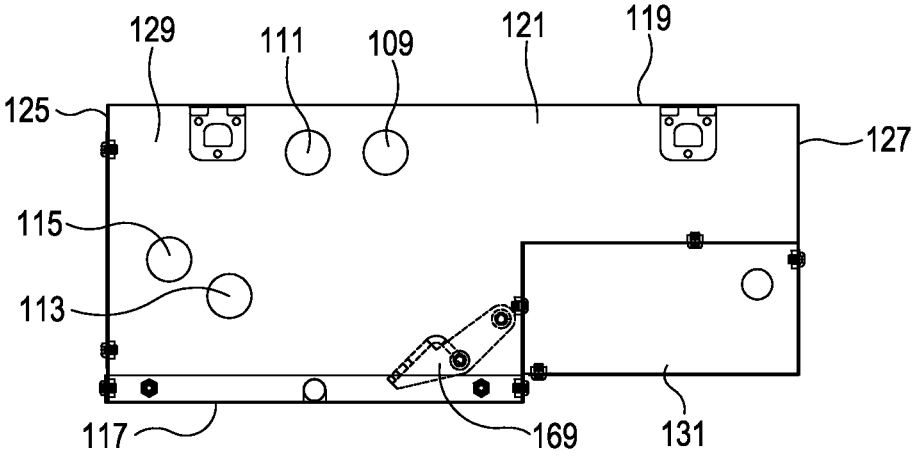
FIG. 8D illustrates the casing of FIG. 8A in end view.
Figure 8E:
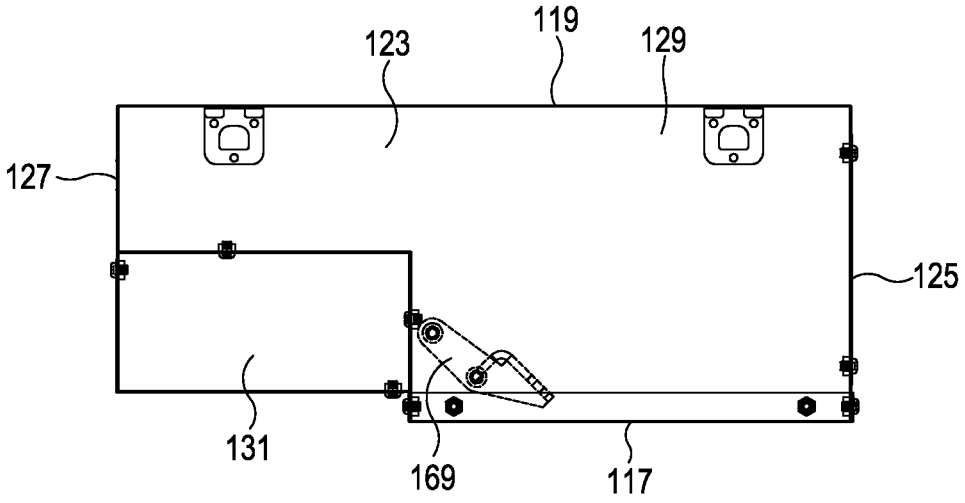
FIG. 8E illustrates the casing of FIG. 8A in end view, from the opposite end to FIG. 8D.

As best shown in FIG. 8A, the VWVK shown has four hanging points 173 suitable for 10 mm drop rod. The hanging points 173 are provided on an exterior of the casing 105, on the end walls 121, 123, and may be used to mount the VWVK 41 in a suitable location. It will be appreciated, however, any suitable hanging points may be provided.

Figure 9:
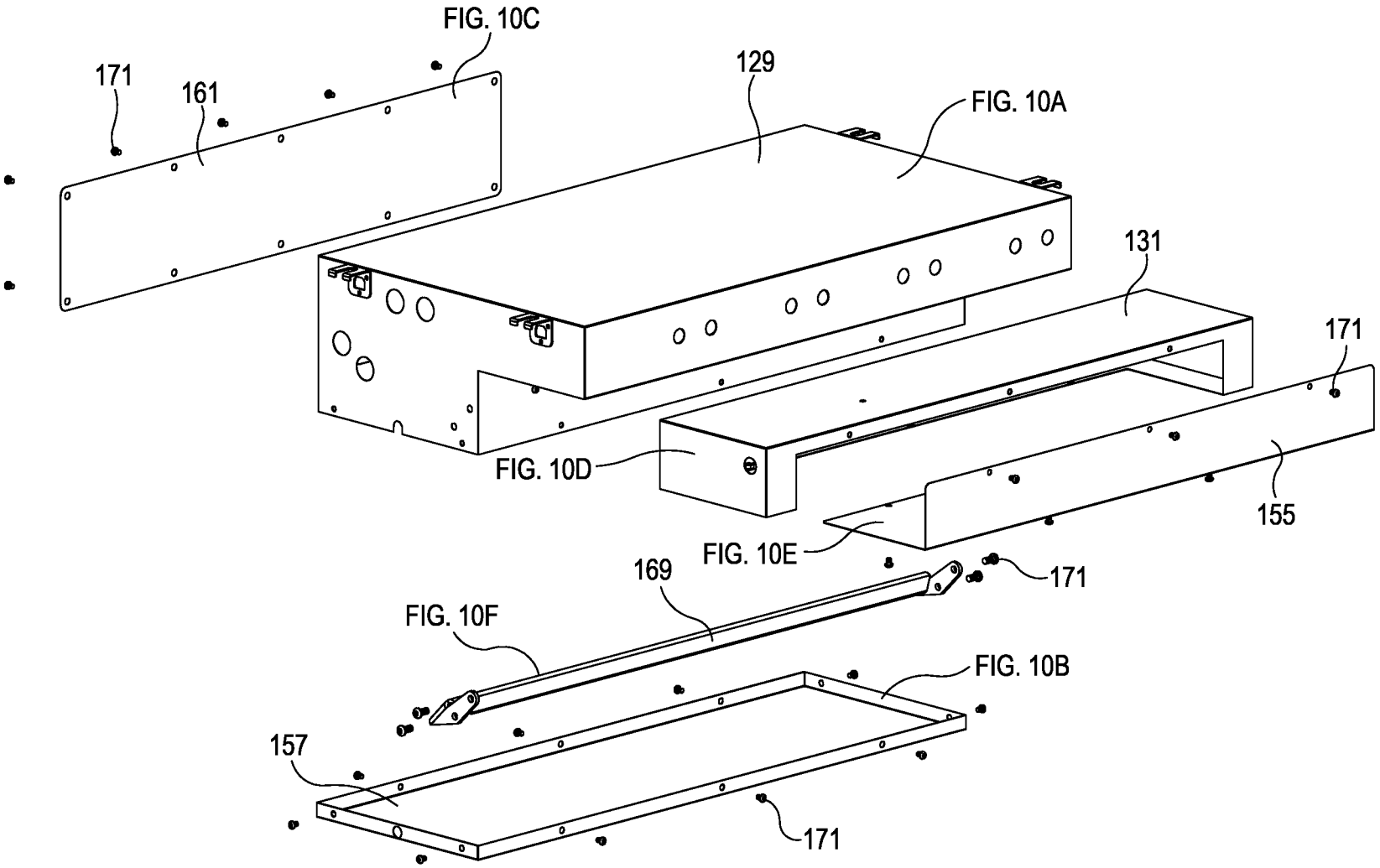
FIG. 9 illustrates the casing of FIG. 8A, in exploded view.

The casing 105 is formed of a number of separate components. FIG. 9 illustrates the components of the casing 105 in exploded view.

A first component of the casing 105 is the pipe enclosure 129. This defines the first chamber 53 that receives the headers 43, 45, 47, 49, control valves 11 and flow sensors 61. A second component is the electrical enclosure 131, which defines the second chamber 55 discussed above, FIG. 10A illustrates the pipe enclosure 129 in more detail, showing a (i) perspective view, (ii) a top view, (iii) a side view and (iv) an end view. FIG. 10 also shows (v) a flat pattern for forming the pipe enclosure 129. The flat pattern is a planar web that, when folded along the corresponding folding lines (shown by broken lines), forms the enclosure 129.

Figure 10A:
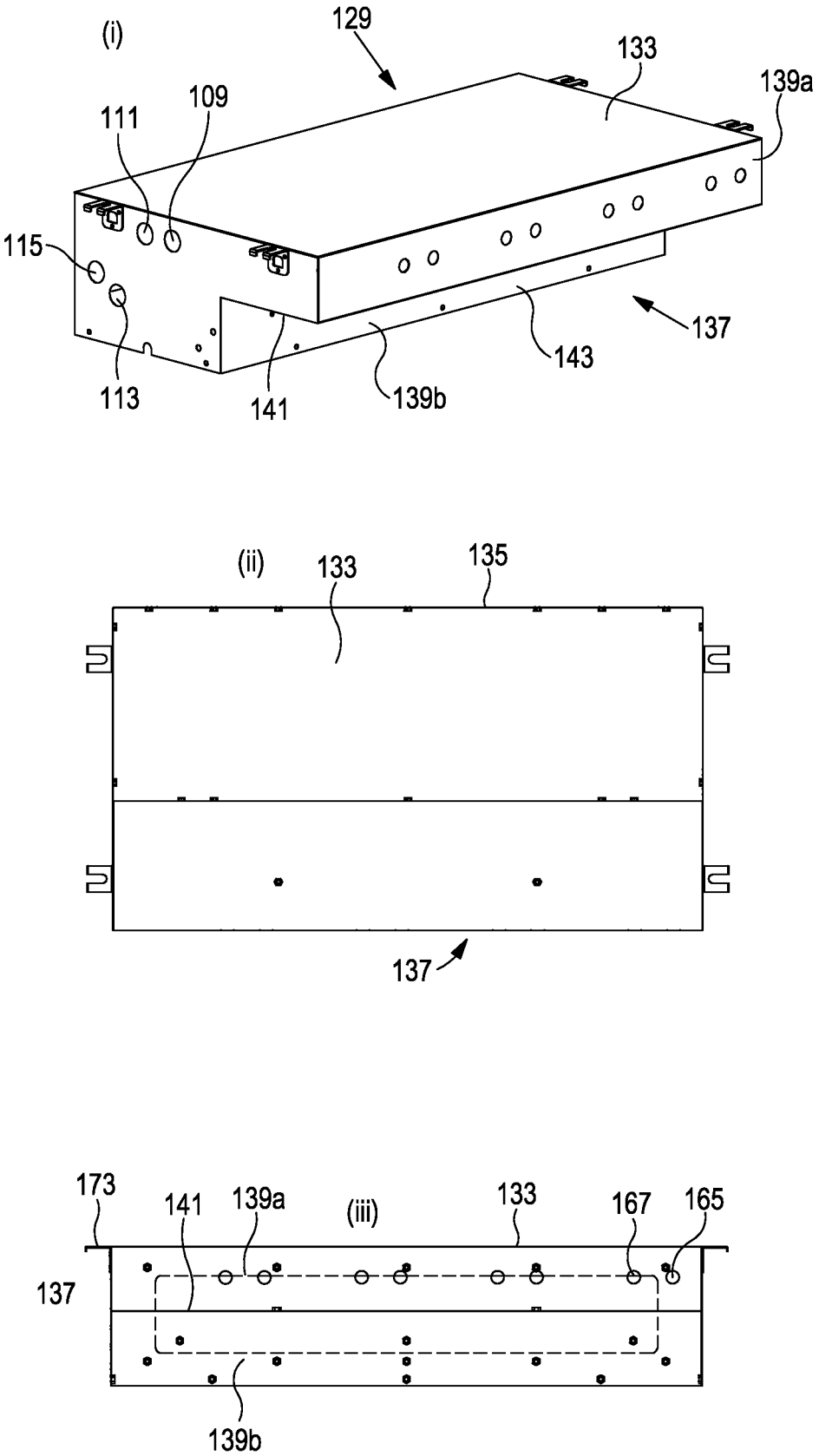
FIGS. 10A to 10F illustrate the components of the casing shown in FIGS. 8A-E and 9, in more detail.
Figure 10A:
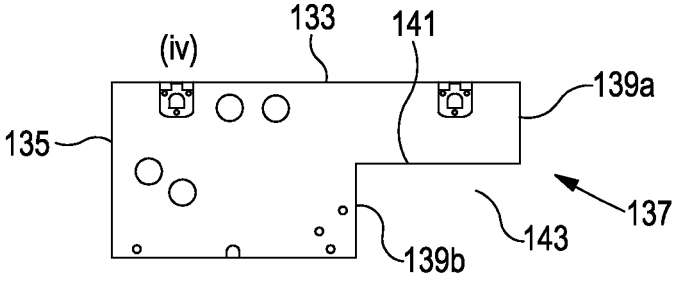
Figure 10A:
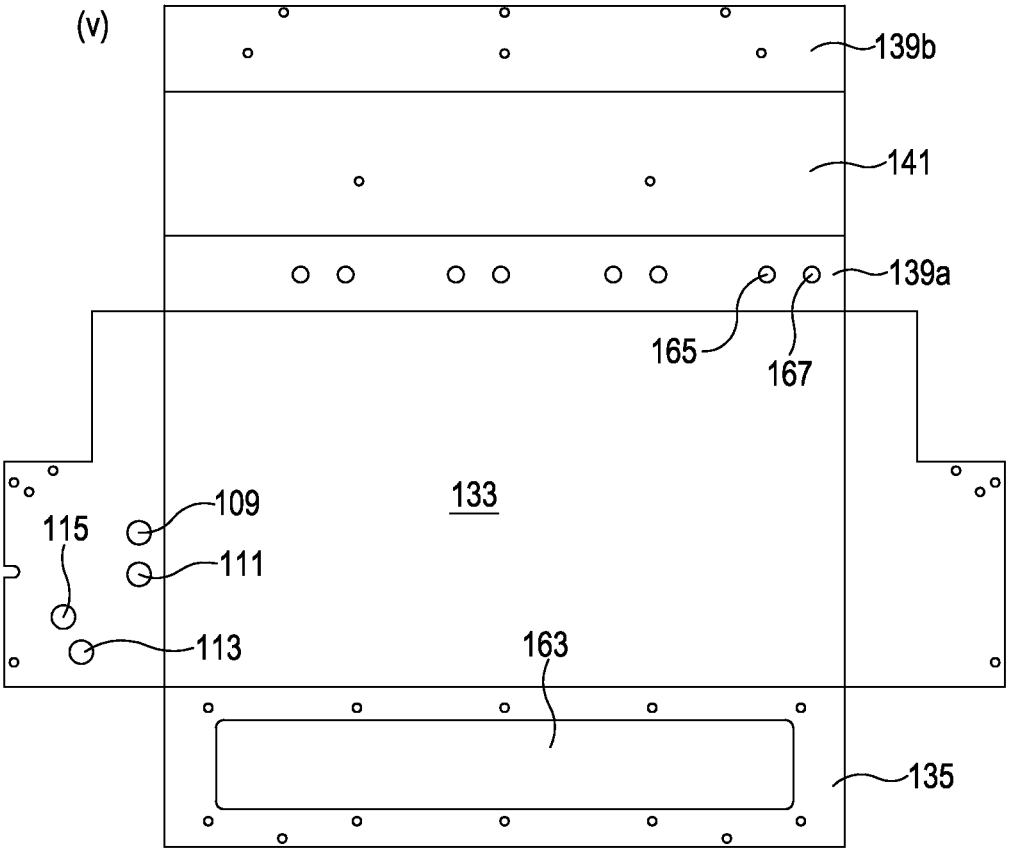
Figure 10B:
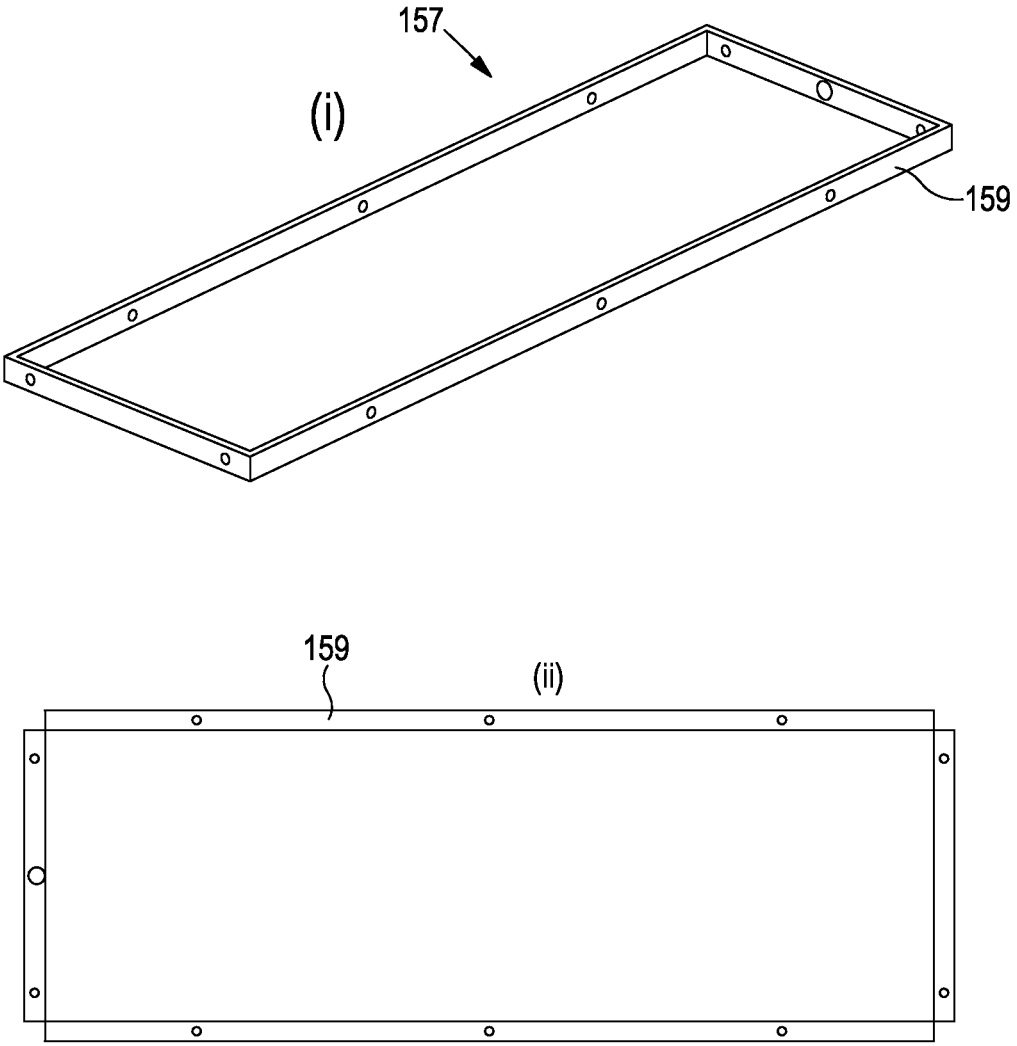
Figure 10C:
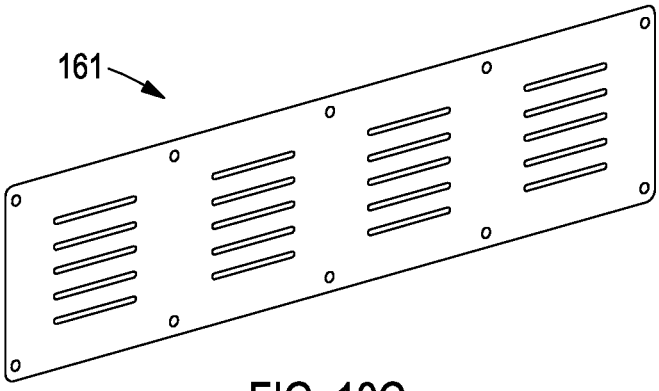
Figure 10D:
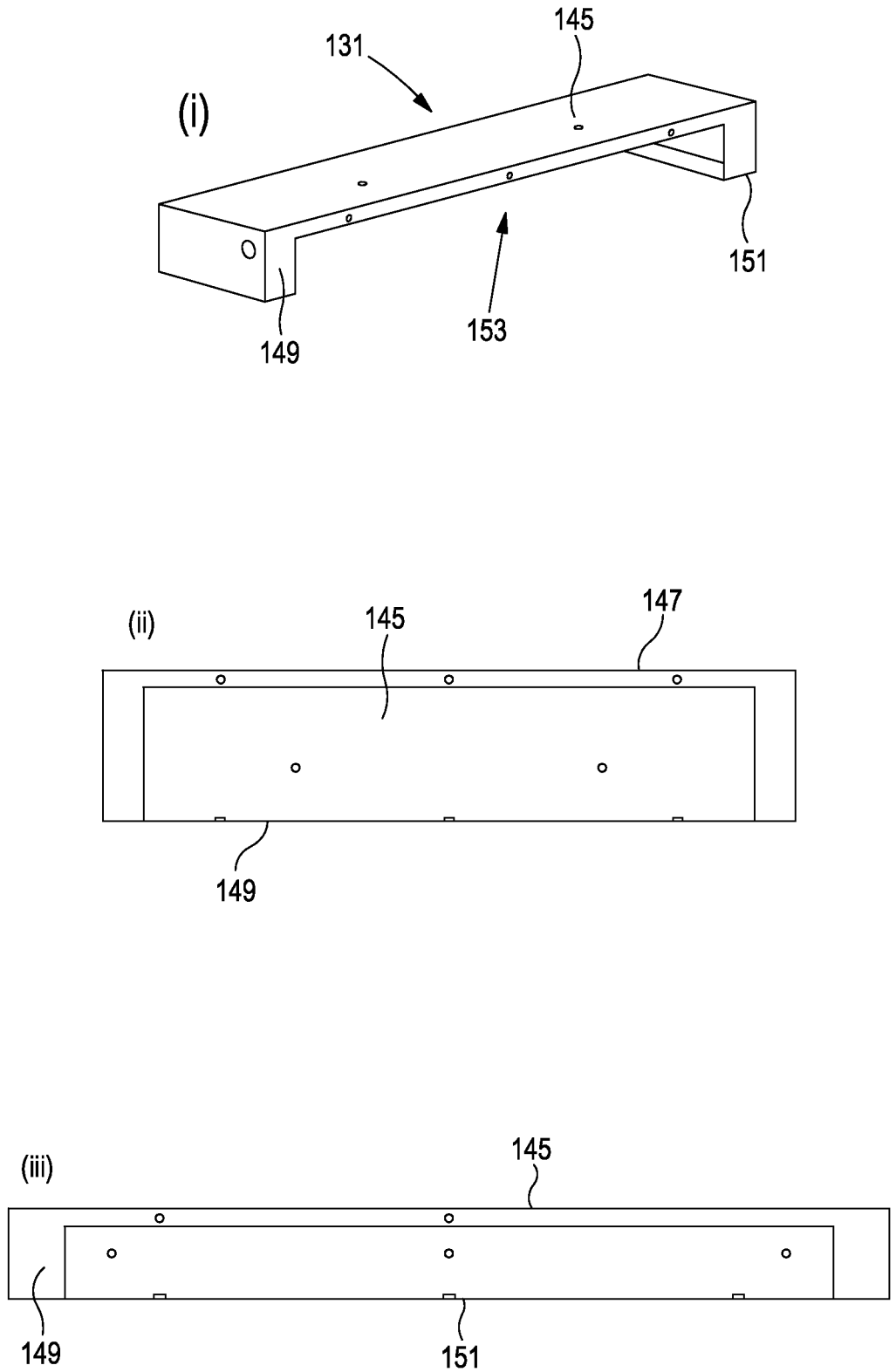
Figure 10D:
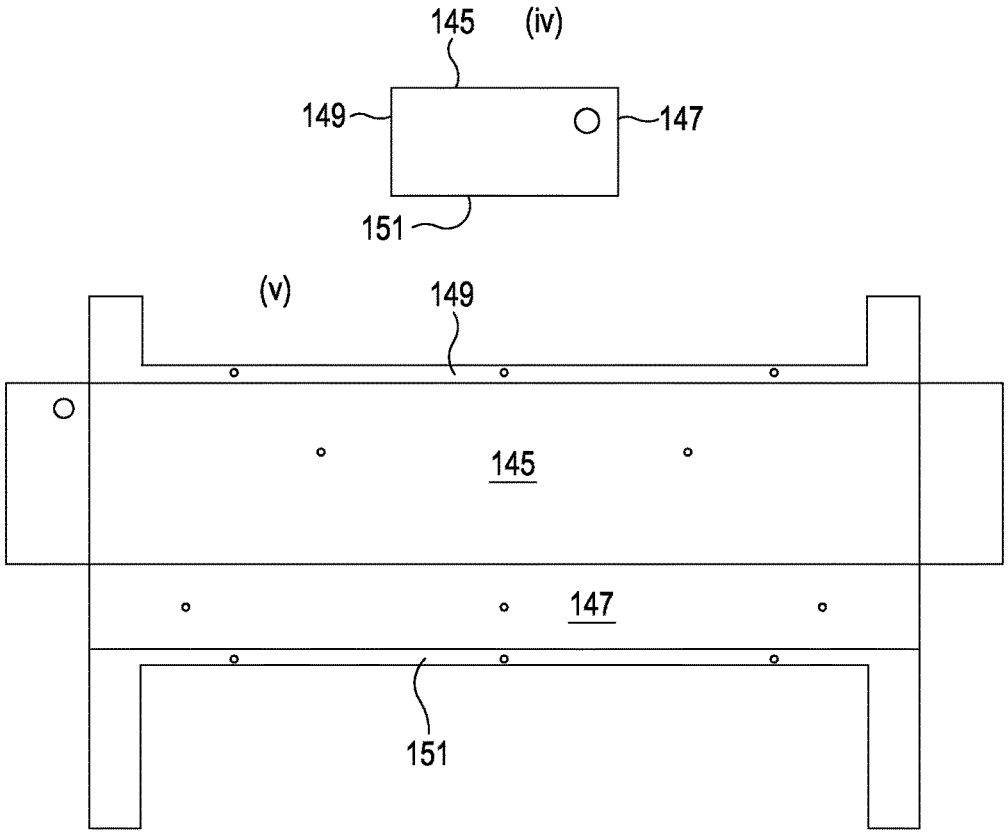

FIG. 10D illustrates the electrical enclosure 131 in more detail, and shows (i) a perspective view, (ii) a top view, (iii) a side view and (iv) an end view. FIG. 10D also shows (v) the flat pattern for forming the electrical enclosure 131.

The pipe enclosure 129 has a top wall 133 forming the top 119 of the casing 105. The base of the pipe enclosure 129, opposite the top 133, is open. The pipe enclosure 129 also includes a first sidewall 135 forming a first side wall 125 of the casing 105. The first sidewall 135 includes an aperture 163 through which the first chamber 53 is accessible.

Opposite the first sidewall 135 of the pipe enclosure 129 is a second sidewall 137. The second sidewall 137 includes a step 141*a*. The width of the first chamber 53 narrows at the step 141*a*. Therefore, the second sidewall 137 of the pipe enclosure 129 is formed a first vertical portion 139*a* and a second vertical portion 139*b*. The first vertical portion 139*a* is adjacent the top 133, whilst the vertical portion 139*b* is adjacent the base 117. At the second vertical portion 139*b*, the width of the first chamber 53 is reduced. The vertical portions 139*a,b* of the second sidewall 137 are joined by a step portion 141 of the wall 137, extending perpendicular to the first and second vertical portions 139*a,b*.

The step 141*a* in the sidewall 137 forms a recess 143 in the pipe enclosure 129. The recess 143 is rectangular in cross-section across the width of the pipe enclosure 129, and extends the length of the pipe enclosure 129. The electrical enclosure 131 is arranged to fit into the recess 143.

The inlet and outlet ports 109, 111, 113, 115 for the headers 43, 45, 47, 49 are formed in an end wall of the pipe enclosure 129. The inlets and outlets 165, 167 for the heat exchangers 17 are formed in the first vertical portion 139*a* of the second sidewall 137.

The electrical enclosure 131 includes a top wall 145 that, in the assembled casing 105, abuts the step wall 141, and a base 151 opposite the top 145. The electrical enclosure 131 also includes a first, inner sidewall 147. In the assembled casing 105, the inner sidewall 147 abuts the second portion 139*b* of the second sidewall 137 of the pipe enclosure 129. Opposite the inner sidewall 147 is an outer sidewall 149. The electrical enclosure also includes end walls.

An opening 153 is formed in the base 151 of the electrical enclosure 131. The opening 153 extends along a portion of the length of the enclosure 131, and extends into and up the outer sidewall 149.

The opening 153 in the electrical enclosure 131 is closed by a lid 155. The lid 155 is L-shaped in cross-section (viewed perpendicular to the length) and closes the opening 153. A pipe enclosure lid 157 closes the open base of the pipe enclosure 129.

Figure 10E:
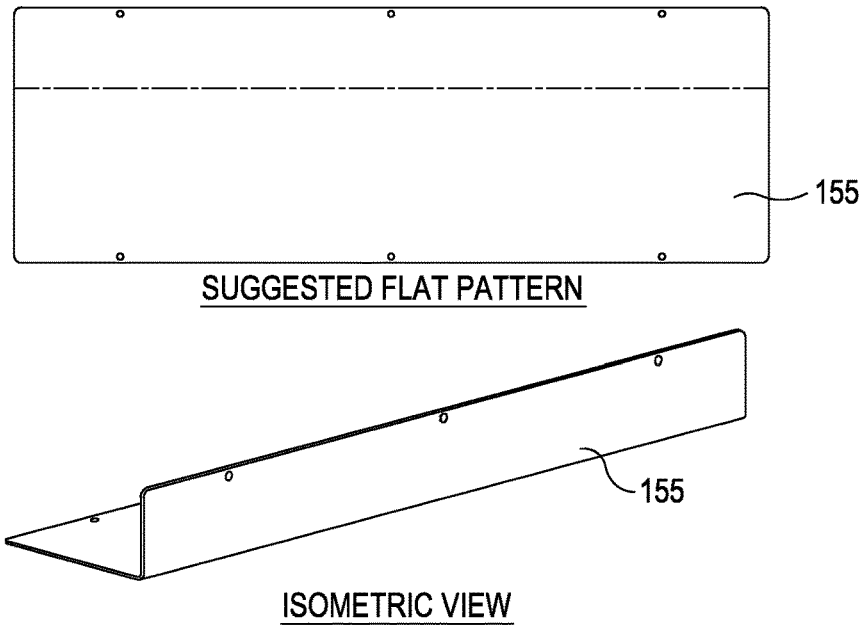

FIG. 10E shows the lid 155 of the electrical enclosure 131, showing (i) a perspective view and (ii) a flat pattern for forming the lid 155. FIG. 10B shows the lid 157 of the pipe enclosure 129, again showing (i) a perspective view and (ii) a flat pattern for forming the lid 157. The pipe enclosure lid 157 includes a lip 159 that extends partially up the sidewalls 135, 139*b* and end walls of the pipe enclosure 129.

A planar cover 161 is provided to close the aperture 163 in the first sidewall 135 of the electrical enclosure. The cover 161 is shown in perspective view in FIG. 10C. As can be seen in FIG. 10C, the cover 161 includes vent slots 165 to allow circulation of air around the first enclosure 53.

It can be seen that the top 119 of the assembled casing 105 is formed by the top 138 of the pipe enclosure 129, and the base 117 of the casing 105 is formed by the lid 157 of the pipe enclosure 129 and the base 151 and lid 155 of the electrical enclosure 131.

The first sidewall 125 of the assembled casing 105 is formed by the first sidewall 135 of the pipe enclosure 129, and the cover 161, whilst the second sidewall 127 is formed by a combination of the second sidewall 137 of the pipe enclosure 129, the outer sidewall 149 of the electrical enclosure 131, and the lid 155 of the electrical enclosure 131. The end walls 121, 123 of the casing 105 are formed by a combination of the pipe enclosure and electrical enclosure 129.

It will be appreciated that the step portion 141 and the second portion 139*b* of the second sidewall 137 of the pipe enclosure 129, along with the inner sidewall 147 and top 145 of the electrical enclosure 131 combine to form a dividing wall separating the chambers 53, 55. Necessary electrical connections may be provided between the chambers 53, 55 to ensure proper control of the valves 11.

Figure 10F:
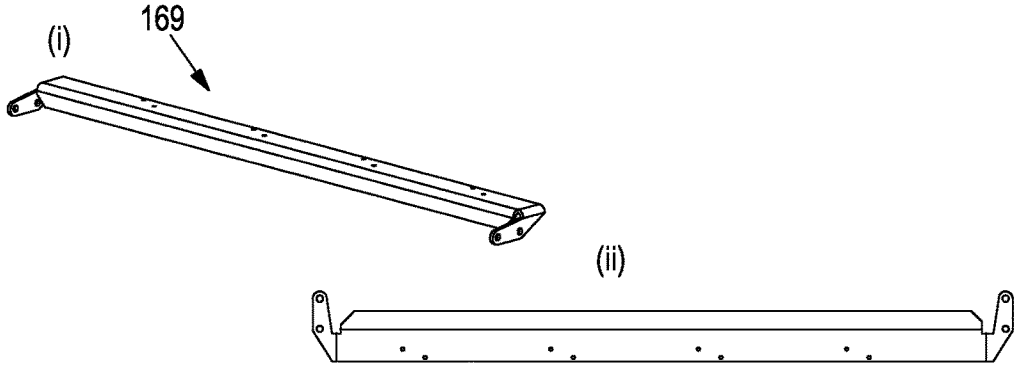

Within the pipe enclosure 129, a control valve mounting bracket 169 is fitted. FIG. 10F shows the bracket 169 in (i) perspective and (ii) flat plan view. The bracket 169 supports the control valves 11 within the VWVK 41, angling them in the correct plane. This may include the support for the flow sensors 61. Other methods for mounting the control valves 11 may also be used.

In the assembled casing 105, the cover 161, electrical enclosure lid 155 and mounting bracket 169 are secured in place by screws 171. The lid 157 of the pipe enclosure 129 is also secured to the pipe enclosure 129 by screws 171, through the lip 159.

In one example, the internal pipework, such as the headers 43, 45, 47, 49 and flow 21*a* to and return from 23*a* the heat exchanger 17 is preformed in copper tubing, with the inlets and outlets 109, 111, 113, 115, 165, 167 from the VWVK 41 sealed via rubber gaskets (not shown). All inlet and out pipework may terminate with a compression fitting for onsite connection.

The internal pipework 43, 45, 47, 49, 21*a*, 23*a* may be sized differently dependant on the number of outlets and kW rating of the VWVK 41. The components and pipework may also be insulated.

A separate electrical panel may be mounted on the VWVK 41 and form part of it. This may be a removable gland plate formed to allow wiring from the valve actuators into the main controller 75. The main electrical enclosure 131 may be IP 56 compliant. A terminal board may be included with the main electrical panel, for all site power and communication wiring. All internal wiring may be included.

Access to the VWVK 141 may be via an access panel formed by the cover 169 on the side of the VWVK 41. This may allow electronic connections for commissioning purposes Access may be also via the lid 157 of the pipe enclosure 129 which forms a removable bottom panel. The lid 157 may also act as a condensate drain pan, with a pipework connection on it and may also prevent overflow of water in the event of a leak. There may be provided two pipework connections to act as drain connections. It may be that one of the drain connections is located to provide convenient drainage when the VWVK is in a horizontal configuration (i.e. when the valves 11 are in a horizontal arrangement), and the other drain connection is located to provide convenient drainage when the VWVK is in a vertical configuration (i.e. when the valves are in a vertical arrangement). It may be that only one drain connection is connected to a drain dependent on the configuration (horizontal or vertical) of the VWVK. Alternatively, only one drain connection may be provided, for either horizontal or vertical installation.

Heat exchanger controllers 67 may be supplied with a control communication PCB, this will be housed in a galvanised case with a terminal strip for power, communication and external devices, such as remote controller and door contactor. These may be supplied to the heat exchanger 17 supplier for fitting and wiring in the factory, prior to installation of the system.

The VWVKs 41 may be sized to fit in spaces above suspended ceilings. Alternatively, the VWVKs 41 may have the option of been made weather proof for outdoor installation in which case the VWVK will be IP66 rated.

As discussed above, any suitable control valve 11 may be used. In one example, the valve 11 may be one of the following valves:

- A 6-way pressure dependent characterized control valve (CCV), such as provided by Belimo®; or
- A 6-way electronic pressure independent valve (ePIV), such as provided by Belimo®

The below table provides examples of physical and operational parameters for a range of different examples of VWVKs 41, incorporating different numbers of valves 11 of different sizes. These are given by way of example only:

| | Units | EG 1 | EG 2 | EG 3 | EG 4 | EG 5 | EG 6 |
|---|---|---|---|---|---|---|---|
| Number of Valves | Max | 4 | 6 | 8 | 4 | 6 | 8 |
| Valve sizes | mm | 15 | 15 | 15 | 20 | 20 | 20 |
| Nominal cooling capacity (per VWVK) | kW | 23 | 35 | 46 | 45 | 60 | 90 |
| Min. cooling capacity (per VWVK) | kW | 5 | 5 | 5 | 16 | 16 | 16 |
| Nominal heating capacity (per VWVK) | kW | 23 | 35 | 46 | 45 | 60 | 90 |
| Min. heating capacity (per VWVK) | kW | 5 | 5 | 5 | 23 | 23 | 23 |
| Capacity Range | KW | 1.25-30 | 1.25-45 | 1.25-60 | 4.18-48 | 4.18-72 | 4.18-96 |
| Nominal flow rate (cooling/heating) | I/s | 0.9 | 1.3 | 1.7 | 1.8 | 2.7 | 3.6 |
| Minimum flow rate (cooling/heating) | I/s | 0.2 | 0.2 | 0.2 | 0.68 | 0.68 | 0.68 |
| Flow rate mains | I/S | 1.4 | 2.1 | 2.8 | 2.6 | 3.9 | 5.2 |
| Nominal pressure drop | kPa | 63 | 66 | 65 | 63 | 62 | 69 |

-continued

| | Units | EG 1 | EG 2 | EG 3 | EG 4 | EG 5 | EG 6 |
|---|---|---|---|---|---|---|---|
| Minimum pressure drop | kPa | 3 | 3.5 | 2.9 | 10 | 10.5 | 10.9 |
| Mains Connection sizes | mm | 28 | 28 | 35 | 35 | 42 | 42 |
| Flow rate from valve max | I/S | 0.35 | 0.35 | 0.35 | 0.65 | 0.65 | 0.65 |
| Flow rate nominal per valve | I/S | 0.23 | 0.23 | 0.23 | 0.45 | 0.45 | 0.45 |
| Heater/chiller connection size | mm | 28 | 28 | 35 | 35 | 35 | 42 |
| Fan coil connection size | mm | 15 | 15 | 15 | 20 | 20 | 20 |
| Height | mm | 216 | 216 | 216 | 225 | 225 | 225 |
| Width | mm | 502 | 502 | 502 | 502 | 502 | 502 |
| Length | mm | 914 | 1334 | 1754 | 914 | 1334 | 1754 |
| Weight | KG | 32.5 | 37.5 | 42.5 | 36 | 41 | 47 |

In all cases in the above table, the communication connection between the VWVK 41 and the heat exchanger 17 is 2 core 0.75 mm screen comms-cable, and the wiring between the VWVKs 41 is CAT 6 or 2 core 0.75 mm. The mains power supply is 240V, single phase, 50 Hz, with a 5A fuse rating.

In the above examples, 2-core comms cable is used for communications links. It will be appreciated that different communications means may be used instead of the 2-core comms cable. This may be Ethernet, wireless such as Wi-Fi, Bluetooth, or infrared, or any other suitable communications means and protocol.

The casing 105 discussed above is given by way of example only. It will be appreciated that any suitable casing may be used to form the enclosure 53 for the pipes and valves 11, and the enclosure 55 for the control electronics.

FIGS. 12A to 12C illustrate one example of an alternative casing 105 for forming the VWVK 41. FIG. 12A illustrates the casing 105 in perspective view, with open sections to illustrate the internal parts of the VWVK 41. FIG. 12B illustrates the VWVK casing 105 in top down view, with the top removed. Unless stated otherwise, the casing 41 shown in FIGS. 12A to 12C is the same as discussed above.

In this alternative example, the pipe enclosure 129, forming the first chamber 53, is a simple cuboid shape. The electrical enclosure 131, forming the second chamber 55, is secured to the end wall 121 of the pipe enclosure 129. Connections (not shown) are provided through the end wall 121, to allow the control electronics to control the valves 11, 61 in the pipe enclosure 129.

FIG. 12C shows an exploded view of the pipe enclosure 129. As in the previous example discussed above, the sidewall of the enclosure 129 includes an aperture, that is closed by a cover 161. The cover may be removed to allow access to the pipe enclosure 129. Also as in the previous examples, the base of the pipe enclosure is open, and is closed by lid 157, allowing further access to the pipe enclosure 129. The mounting bracket 169 is received within the pipe enclosure 129, as discussed above.

The electrical enclosure 131 is formed of a simple housing, which can be fixed to the end wall of the pipe enclosure 129 by screw fixings or the like.

The VWVK 41 illustrated in FIGS. 12A to 12C provides a greater volume for receiving the headers 43, 45, 47, 49 and valves 11, 61.

In yet further examples, the electrical enclosure 131 may then fit completely within the volume defined by the pipe enclosure 129, or the enclosures 129, 131 may be formed in any other way. In yet further examples, the electrical enclosure 131 may be provided separately, remote from the casing 105.

The VWVK 41 illustrated in FIGS. 12A and 12C may include drain connections, as in the embodiment discussed above. The drain pan in either embodiment may be arranged in any suitable way, and does not necessarily have to be formed in the lid, as discussed above.

The VWVK 41 may include air bleeding valves. These bleed valves are configured to allow air to escape from the system and as such may be mounted at the highest connections in the VWVK. The bleed valves may be present on the main inlets and outlets 109, 111, 113, 115, 165, 167 from the VWVK 41.

FIG. 11 illustrates an example of a building 175 including an air conditioning system 1 as discussed above.

The building 175 has four different floors 177*a,b,c,d*, each with the air conditioning arranged in a different manner, to illustrate the different possible arrangements. A heater/chiller unit 77 is provided externally of the building 175, for example on the roof. The heater/chiller unit 77 is connected to hot and cold building headers 83, 85, 87, 89 extending from the cooler and chiller 77, as discussed above.

As also discussed above, the building headers 83, 85, 87, 89 may include return connections to complete the hot and cold water loops, to ensure that both loops are completed and water is circulated, even when all valves 11 are in in the same mode (i.e. hot or cold) or in the off position. Instead of or as well as this, any branches from the building headers 83, 85, 87, 89 may include return connections.

On the ground floor 177*a*, the VWVK 41 has a single valve 11 with a flow connection and a return connection to a single heat exchanger 17. The temperature in the area 179 on the ground floor 177*a* is controlled by the heat exchanger 17 and the valve 11. For example, to heat the ground floor 177*a*, the hot water flow 7 is provided to the heat exchanger 17, and to cool it the cold water flow 13 is provided.

On the first floor 177*b*, a number of different VWVKs 41 are provided, each with a number of control way valves 11 connected by flow and return pipes 21*a*, 23*a* to heat exchangers 17. Different temperatures can be set in different areas 181*a* of the first floor, by controlling the heat exchangers 17 and valves 11 separately. The different areas 181*a* may be separate rooms, or simply different areas of the same open space.

The first two WVWKs 41 (in the flow direction from the heater/chiller 77) have openings at both ends 121, 123, such that the hot and cold flow and return pipes 7*a*, 13*a*, 31*a*, 33*a* may continue on to the next VWVK 41. In these examples, the headers 43, 45, 47, 49 continue through the VWVK 41, rather than terminating within it.

The second floor 177*c* gives an alternative example that is similar to the second floor 177*b*. However, in this example, each VWVK 41 is connected to the building headers 83, 85, 87, 89 separately. Different temperatures can be set in different areas 181*b* of the second floor 177*c* in a similar manner to the first floor 177*b*.

On the third floor 177*d*, a single VWVK 41 is provided, with a number of valves 11, each connected to a heat exchanger 17 by flow and return pipes 21*a*, 23*a*. Different temperatures can be set in different areas 183 of the second floor 177*c*, by controlling the heat exchangers 17 and valves 11 separately. The different areas 183 may be separate rooms, or simply different areas of the same open space.

Each of the separate areas 179, 181*a,b*, 183 in the building 175 may have a separate thermostatic controller 65 to enable separate control of the areas. The heating mode of each area may be controlled by a heating program that sets different modes/temperatures at different times. Alternatively, the system may be switched between modes manually (for example by a key card), or based on detection of occupancy of the space 179, 181*a,b*, 183.

It will also be appreciated that control of the heater/chiller unit 77 may help to control the temperatures of the areas.

Where necessary, piping, such as headers 83, 85, 87, 89 extending from the heater/chiller unit 77 may be provided externally of the building 175, or in a service space 185. It will be appreciated that to ensure the pressure does not drop in the system 1, the building headers 83, 85, 87, 89 will be of larger diameter than headers 43, 45, 47, 49 in the VWVKs 41. Furthermore, where multiple VWVKs 41 are connected in series, the diameter of the headers 43, 45, 47, 49 in VWVKs 41 closer to the building headers 83, 85, 87, 89 will be larger than headers 43, 45, 47, 49 in VWVKs 41 further away.

It will be appreciated that the example discussed above is only one possible way of arranging a building 175, and has only been given by way of example only. Any suitable air conditioning system 1 making use of one or more VWVK 41 may be implemented, and the temperature in each area 179, 181*a,b*, 183 of the building may be controlled in any of the manners discussed above.

The systems discussed above provide a number of benefits. These include, but are not limited to:

- No refrigerant in the building
- Larger capacity than refrigerant based systems
- Flexibility of system set up
- Simple installation
- Nitrogen purge of pipework not required
- Material costs lower
- Speed of installation
- No brazing
- Compression fitting pipework only required (although any type of connection can be used)
- Built in controls
- Two pipes only between the VWVK 41 and the heat exchanger 17
- Can be used with door heaters
- All pipework can be plastic, copper or aluminium
- Low pressure operation
- Reduced fan power compared to water based system, due to lower air side pressure drops on heat exchanger
- No high pressure testing required
- Lower maintenance
- Closer control
- No cold drafts and more precise room temperatures
- No boilers required
- By product of free hot water
- No defrost
- Simultaneous heating and cooling
- Huge range of options
- Modular system for modular construction projects
- Independent indoor unit control simultaneously
- Reduced control wiring
- Fresh air systems can be controlled on same system
- Can be combined with any fan coil unit manufacturer or heat exchanger
- Can be combined with any manufacturers chiller, boilers or heat pumps

The invention claimed is:

1. An air conditioning system comprising:

a hot water loop and a cold water loop;

a heater unit for providing a hot water flow and receiving a hot water return in the hot water loop;

a chiller unit for providing a cold water flow and receiving a cold water return in the cold water loop;

a first air to water heat exchanger having a first heat exchanger controller;

a second air to water heat exchanger having a second heat exchanger controller; and a changeover box arranged to provide a connection between the heater unit and chiller unit, and the first and second air to water heat exchangers, the changeover box enclosing:

a first control valve coupled to the first air to water heat exchanger and a second control valve coupled to the second air to water heat exchanger, wherein:

each of the first control valve and second control valve is arranged to:

receive the hot water flow in the hot water loop and the cold water flow in the cold water loop;

selectively provide the flow from one of the hot water loop or the cold water loop to the associated air to water heat exchanger;

receive a return from the associated air to water heat exchanger; and selectively provide the return from the associated air to water heat exchanger to the return of the one of the hot water loop or the cold water loop;

the changeover box includes a changeover box controller arranged to operate the first and second control valves, and the first and second air to water heat exchangers;

the first heat exchanger controller is in connection with the changeover box controller via a first communications link; and the second heat exchanger controller is in connection with the first heat exchanger controller via a second communications link, such that the second heat exchanger controller is in communication with the changeover box controller via the first and second communication links.

2. The air conditioning system of claim 1, wherein each of the first and second air to water heat exchangers comprise one of: a fan coil unit, a chilled beam unit or an air-handling unit.

3. The air conditioning system of claim 1, wherein the changeover box comprises:

a hot flow header arranged to provide the hot flow to the first and second control valves;

a cold flow header arranged to provide the cold flow to the first and second control valves;

a hot return header arranged to couple the hot return to the first and second control valves; and a cold return header arranged to couple cold return to the first and second control valves.

4. The air conditioning system of claim 3, wherein the changeover box further comprises a housing defining a volume receiving the first and second control valves, the hot and cold flow headers, and the hot and cold return headers.

5. The air conditioning system of claim 4, wherein the housing further comprises a dividing wall splitting the volume into a first chamber and a second chamber, separate from the first chamber, wherein the first chamber receives the first and second control valves, the hot and cold flow headers, and the hot and cold return headers and wherein the second chamber receives a plurality of control electronics for operating the first and second control valves.

6. The air conditioning system of claim 5, wherein the housing further comprises:

a first lid arranged to close the second chamber; and a second lid arranged to close the first chamber.

7. The air conditioning system of claim 1, including a first thermostatic controller, wherein the changeover box controller is arranged to:

receive an input from the first thermostatic controller, the input indicative of a desired temperature in the region of the first and/or second air to water heat exchanger; and operate the first and/or second control valves and the first and/or second air to water heat exchangers based on the received input.

8. The air conditioning system of claim 7, wherein the changeover box controller is arranged to receive the input from the first thermostatic controller via the first or second heat exchanger controller.

9. The air conditioning system of claim 8, further comprising a second thermostatic controller, wherein the changeover box controller is arranged to:

receive an input from the first thermostatic controller, the input indicative of a desired temperature in the region of the first air to water heat exchanger;

receive an input from the second thermostatic controller, the input indicative of a desired temperature in the region of the second air to water heat exchanger;

operate the first and second control valves and the first and second air to water heat exchangers based on the received inputs, wherein the first and second heat exchanger controllers and the changeover box controller are arranged such that the first and second control valves and/or the first and second air to water heat exchangers are separately controllable, to provide different temperatures in a vicinity of the first and second air to water heat exchangers.

10. The air conditioning system as claimed in claim 1, further comprising:

a third air to water heat exchanger having a third heat exchanger controller;

a second changeover box, arranged to provide a connection between the heater unit and chiller unit, and the third air to water heat exchanger, the second changeover box enclosing a third control valve coupled to the third air to water heat exchanger, wherein the third control valve is arranged to: receive the hot water flow in the hot water loop and the cold water flow in the cold water loop; selectively provide the flow from a one of the hot water loop or the cold water loop to the third air to water heat exchanger; receive a return from the third air to water heat exchanger; and selectively provide the return from the third air to water heat exchanger to the return of the one of the hot water loop or the cold water loop;

the second changeover box includes a second changeover box controller arranged to operate the third control valve and the third air to water heat exchanger; and the third heat exchanger controller is in connection with the second changeover box controller via a third communications link.

11. The air conditioning system of claim 7, further comprising a system controller arranged to control the operation of the system.

12. The air conditioning system of claim 11, wherein:

the first changeover box controller is in communication with the system controller via a first control link; and the second changeover box controller is in communication with the first changeover box controller via a second control link, such that the second changeover box controller is in communication with the system controller via the first and second control links.

13. The air conditioning system of claim 1, wherein the changeover box comprises 2, 4, 6, 8, 12 or 16 control valves, each control valve coupled to a corresponding air to water heat exchanger, each arranged to: receive the hot water flow in the hot water loop and the cold water flow in the cold water loop; selectively provide the flow from a one of the hot water loop or the cold water loop to the associated air to water heat exchanger; receive a return from the associated air to water heat exchanger; and selectively provide the return from the associated air to water heat exchanger to the return of the one of the hot water loop or the cold water loop.

14. The air conditioning system of claim 1, wherein the first and second control valves comprise six-way valves.

15. The air conditioning system of claim 11, wherein the system controller is arranged to override the first and second changeover box controllers.

16. The air conditioning system as of claim 11, wherein the system controller is configured to regulate a water flow in the system, via the first and second control valves.

17. The air conditioning system 15, further comprising:

a first building header for supplying the hot water flow to the first and second changeover boxes;

a second building header for supplying the cold water flow to the first and second changeover boxes;

a third building header for receiving the hot water return from the first and second changeover boxes; and a fourth building header for receiving the cold water return from the first and second changeover boxes, wherein each of the first and second changeover boxes is connected to the building headers by separate connections.

18. The air conditioning system of claim 17, wherein the building headers comprise pipes having a first diameter, and wherein connections between the first and second changeover boxes and the air to water heat exchangers comprise pipes having a second diameter, smaller than the first diameter.

19. A changeover box for controlling flow of hot and cold water in an air conditioning system, the changeover box comprising:

a first input arranged to receive a hot water flow from a hot water loop of the air conditioning system;

a first output arranged to provide a hot water return to the hot water loop of the air conditioning system;

a second input arranged to receive a cold water flow from a cold water loop of the air conditioning system;

a second output arranged to provide a cold water return to the cold water loop of the air conditioning system;

a third output arranged to provide flow to a first air to water heat exchanger;

a third input arranged to receive a return from the first air to water heat exchanger;

a fourth output arranged to provide flow to a second air to water heat exchanger;

a fourth input arranged to receive a return from the second air to water heat exchanger;

a first control valve arranged to be coupled to the first air to water heat exchanger;

a second control valve coupled to the second air to water heat exchanger;

a changeover box controller arranged to operate the first and second control valves, and the first and second air to water heat exchangers, wherein:

each of the first control valve and second control valve is arranged to: receive the hot water flow in from the hot water loop and the cold water flow from the cold water loop; selectively provide the flow from a one of the hot water loop or the cold water loop to the associated air to water heat exchanger; receive return from the associated air to water heat exchanger; and selectively provide the return from the associated air to water heat exchanger to the return of the one of the hot water loop or the cold water loop;

the changeover box controller is arranged to connect to a heat exchanger controller of the first air to water heat exchanger via a first communication link; and the changeover box controller is arranged to connect to a heat exchanger controller of the second air to water heat exchanger via the first communication link and a second communication link between the heat exchanger controller of the first air to water heat exchanger and the heat exchanger controller of the second air to water heat exchanger.

20. A kit arranged to form an air conditioning system, the kit including:

a changeover box as claimed in claim 19;

a heater unit arranged to be connected to the first input and first output of the changeover box, the heater unit for providing a hot water flow and receiving hot water return;

a chiller unit arranged to be connected to the second input and second output of the changeover box, the chiller unit for providing the cold water flow and receiving the cold water return;

a first air to water heat exchanger arranged to be connected to the third output and third input of the changeover box; and a second air to water heat exchanger arranged to be connected to the fourth output and fourth input of the changeover box.

* * * * *